United States Patent [19]

Diola et al.

[11] Patent Number: 4,728,987

[45] Date of Patent: Mar. 1, 1988

[54] CAROUSEL-MOUNTED MODULAR DEVELOPMENT UNITS FOR ELECTROGRAPHIC PRINTER

[75] Inventors: David J. Diola, Santa Cruz; Russell A. Stauffer, Nevada City; Peter A. Tapscott, Portola Valley , all of Calif.; Mark E. Martich, Seekonk, Mass.

[73] Assignee: Xerox Corporation, Stamford, Conn.

[21] Appl. No.: 880,756

[22] Filed: Jul. 1, 1986

[51] Int. Cl.[4] ..... G03G 15/01; G03G 15/10

[52] U.S. Cl. ..... 355/3 DD; 355/4; 355/10; 355/14 D; 118/645; 430/117

[58] Field of Search ..... 355/4, 14 D, 3 DD, 10; 118/653, 645, 659; 430/119, 120, 117, 118

[56] References Cited

U.S. PATENT DOCUMENTS

| | | | |
|---|---|---|---|
| 3,987,756 | 10/1976 | Katayama et al. | 355/4 X |
| 4,289,092 | 9/1981 | McChesney et al. | 118/660 |
| 4,454,833 | 6/1984 | McChesney et al. | 118/652 |
| 4,540,268 | 9/1985 | Toyono et al. | 355/3 R |
| 4,569,584 | 2/1986 | St. John et al. | 355/14 R |
| 4,593,991 | 6/1986 | Aoki et al. | 355/4 X |
| 4,615,612 | 10/1986 | Ohno et al. | 355/4 X |
| 4,620,783 | 11/1986 | Tanaka et al. | 355/4 X |

*Primary Examiner*—A. C. Prescott

*Attorney, Agent, or Firm*—W. Douglas Carothers, Jr.

[57] ABSTRACT

A toner or development unit arrangement for an electrographic printer or plotter in which each of the toner units is modular and can be readily removed and replaced by the user. In addition, the units are mounted in a rotating support, generally referred to herein as a carousel, which is compact and which rotates each of the units into the same position for printing, simplifying the movements of the medium past the development units. As a result, the moving parts within each unit are driven by the same set of drivers, to which each toner unit is coupled by coupling means when a selected toner is in the printing position. Also, disclosed is a method of quickly establishing a toner meniscus where the toner unit engages the medium surface as soon as the toner pump is activated. Further, cam operated means is provided to operate the medium cutter in conjunction with a cutter stepper motor.

14 Claims, 22 Drawing Figures

CAROUSEL-MOUNTED MODULAR DEVELOPMENT UNITS FOR ELECTROGRAPHIC PRINTER

BACKGROUND OF THE INVENTION

The present invention relates to a technique of providing toner or developer to be applied to a recording medium such as paper or film during electrographic printing. More specifically, the invention relates to a rotating support or carousel on which are mounted modular toner or developer units, each carrying a liquid toner of a specific color to be applied to the medium.

The conventional color electrographic printing apparatus provides means for forming a plurality of superimposed component images of different colors on a recording medium to produce a composite color image. An example of such apparatus is found in U.S. Patent 4,569,584. The apparatus comprises a single recording station having a recording electrode means for forming a latent image on the recording medium and a plurality of developing units, e.g. toner fountains, adjacent either one side or both sides of recording station wherein each developing unit is provided with a respective color toner to form a color image component of the composite image. The apparatus includes means to transport the recording medium in opposite directions through the apparatus so that a first latent component image is formed at the recording head followed by its color component development. Then recording medium reversal is accomplished at least once so that a second latent component image is formed superimposed over the fist developed component image followed by its color component development. Then recording medium reversal is accomplished at least once so that a third latent component image is formed superimposed over the first and second developed component images. The process may then repeat again for as many color component images desired. At a minimum, it is preferred that four color component images be involved, i.e., magneta, cyan, yellow and black.

Different types of developer units are in use. As an example, one type is the open fountain arrangement where liquid toner is pumped to a surface forming a fountain or toner stream for engaging the recording medium. Such a development unit is illustrated in U.S. Pat. No. 4,289,092. Another type is the applicator roller and dry roller combination development unit which provides a toner film supplied to a development gap formed between the applicator roller and an opposed roller through which the medium is passed to engage the toner meniscus formed at the gap. An oppositely rotated roller down stream from the applicator roll wipes and drys the medium of excess toner. Such a development unit is illustrated in U.S. Pat. No. 4,454,833. U.S. patent application Ser. No. 06/880,772 filed 7/1/86 illustrates a development unit utilizing a single applicator/wipe roller for both applying toner to the recording medium at development apex and wiping from its surface excess toner and promoting the dry of the medium surface.

In the conventional color electrographic apparatus, the line of developer units are individually elevated to be in contact with the recording medium for the printing of the particular component color. When the printing of that color is complete, the unit is returned to a resting position, and another unit is elevated to print another color. The apparatus moves the recording medium being printed back and forth, positioning the particular medium section being imaged and developed successively above each elevated unit until all the component colors have been printed. Each unit includes its own operating components such as a toner pump, toner reservoir, applicator roller and dry roll (if a roll type development unit), etc. which are driven by attached machinery, so that the units are not readily removed and replaced.

It is known in the electrophotographic copying art to provide a removable process kit including image forming means, so that the kit may be replaced without calling service personnel. U.S. Pat. No. 4,540,268, for example, discusses such a process kit and an image forming apparatus using the kit. In one variation, the kit includes a stationary toner reservoir, containing an appropriate electrophotographic toner.

It would be advantageous to have removable development units in an electrographic printing apparatus, because the development units are susceptible to mechanical problems resulting from the wearing of parts and from the liquid toner itself, which may dry on parts of the unit or plug the orifices or passages within the development unit. These units could be easily replaced by an user or customer without the need or necessity to contact the manufacturer's technical representative. It would be further advantageous (1) to provide a more compact arrangement of the development units within the machine and (2) to provide an arrangement which would simplify the movements of the medium past the development units, such as shortening medium distance between the electrographic recording means and the development units which has the advantages of (i) reducing medium waste, (ii) rendering the medium path shorter thereby making the apparatus bed more compact and (iii) eliminating, in at least some cases, the need for a medium tracking system, such as disclosed in U.S. Pat. No. 4,569,584, to determine if the medium section being imaged and developed has expanded or shrunk so that imaging corrections can be introduced upon subsequent passes of the medium section through the apparatus to insure that each color component image being formed is properly superimposed on other component color images to form a high resolution composite color image.

SUMMARY OF THE INVENTION

The present invention provides a toner or development unit arrangement for a printer in which each of the units is modular and can be readily removed and replaced by the user. In addition, the units are mounted in a rotating support, generally referred to herein as a carousel, which is compact and which rotates each of the units into the same position for printing, simplifying the movements of the medium past the development units. As a result, the moving parts within each unit are driven by the same set of drivers, to which each unit is coupled by coupling means when it is in the printing position.

A development unit arrangement according to the invention includes a rotatable support and toner units mounted on the support so that as the support rotates, each unit is rotated into a printing position for applying toner to the recording medium. The toner units are removably mounted on the support, permitting easy replacement. Aligning means serve to align each unit correctly in the printing position, and also may hold the units in upright position as they rotate with the carousel. Each unit includes toner applying means driven through coupling means by a driving means when that unit is in the printing position. The toner applying means includes a toner pump and an applicator, which are separately driven.

A printer according to the invention includes a rotatable support with toner units, a main driver for rotating the support to successively bring each toner unit into printing position, and control means for controlling the main driver and the driving means for the toner applying means in the units so that the driving means operates only when the main driver has stopped with one of the toner units in printing position. The printer also includes a roll of the medium and means to drive the medium forward and backward, the control means controlling the medium drive means so that the medium moves forward while the toner applying assembly of one unit is operating and backward to a starting position before another starts to operate, until printing is completed.

A modular toner according to the invention includes a toner reservoir, means for applying toner from the reservoir to a medium, and mounting means for removably mounting the unit on a support. The unit also includes coupling means for coupling the toner applying means to an external driver. The toner applying means includes a toner pump which may be an auger and an applicator which may be a roller cleaned by a blade.

Other objects and attainments together with a fuller understanding of the invention will become apparent and appreciated by referring to the following description and claims taken in conjunction with the accompanying drawings.

DETAILED DESCRIPTION OF THE PREFERRED EMBODIMENTS

Figure 1:
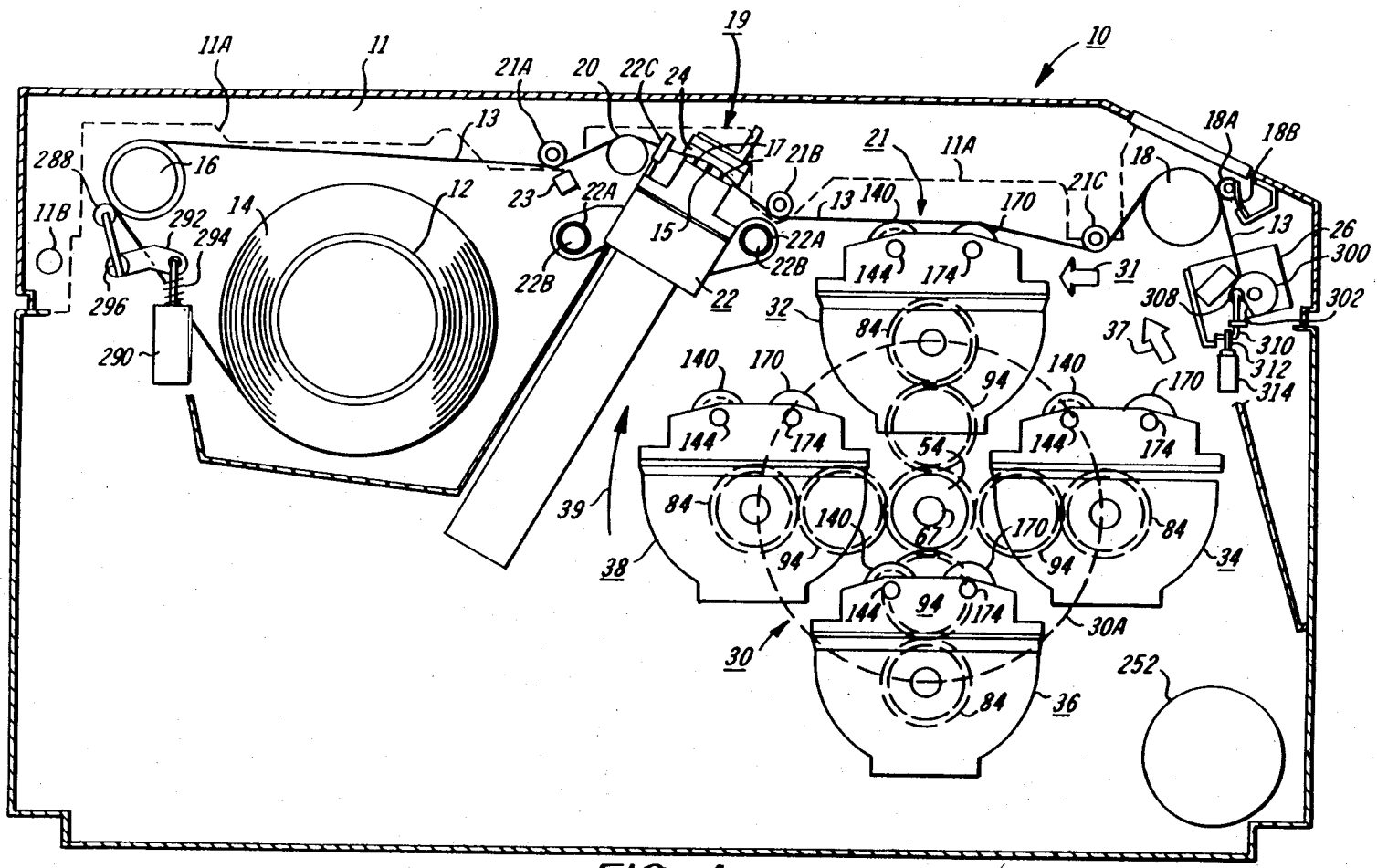
FIG. 1 is a schematic diagram of an electrostatic printer according to the invention.
Figure 2:
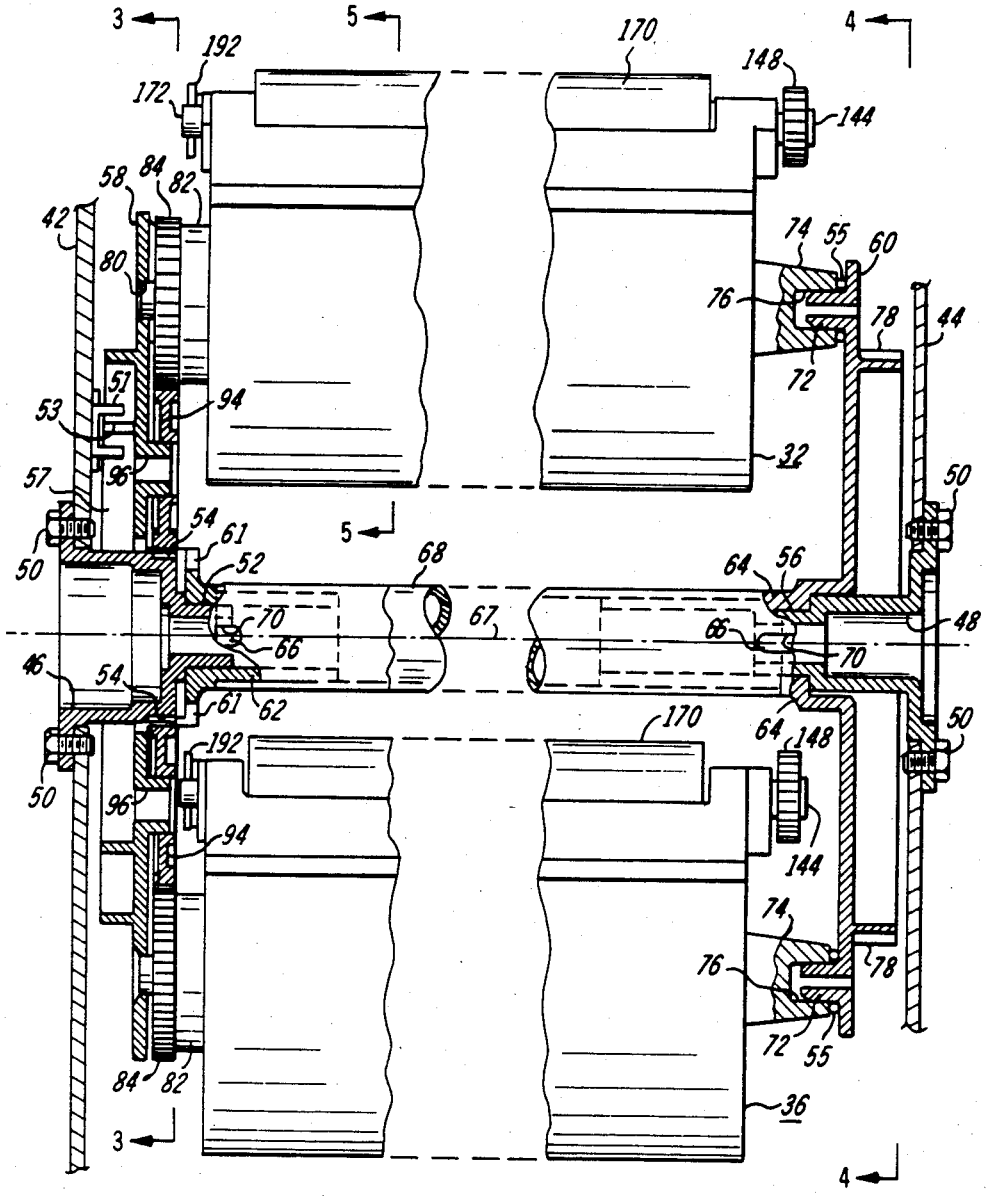
FIG. 2 is a side elevation in partial cross section of the carousel of FIG. 1, showing a modular toner unit in the printing position.

FIGS. 1 and 2 illustrate general features of an electrographic printer of the electrostatic type. Electrostatic printing, as used herein, includes any process in which an image is produced by depositing or otherwise creating electrostatic charges in imagewise formation on the surface of a medium, such as paper or film, and then exposing the medium surface to a liquid or powder toner which adheres and fixes or is fixed to the charged areas. The term, "printer" also means graphic plotters as well as alphanumeric printing. More generally, however, the invention is applicable to any electrographic printing process in which fluid toner, whether in liquid, powder or other form, is applied to a medium to produce an image. Also, the developing or toner unit is equally applicable to the toning of individuals sheets of recording medium as well as a continuous web of recording medium.

FIG. 1 shows schematically an electrostatic printer 10 which has a lid 11 (outlined in part at dotted line 11A) and is pivotally secured at 11B to permit access into the interior of printer 10. Roll 12 is rotatably mounted in printer 10 and contains a roll of a suitable recording medium 14, such as paper or film. For electrostatic printing, medium 14 may be dielectrically coated for receiving and holding electrostatic charge. During operation of printer 10, medium 14 is unwound from and rewound onto roll 12 and passes forward and backward along a medium path 13 through printer 10 along which a number of operations are performed on it. As will be explained in greater detail below, medium 14 may be unwound and rewound onto roll 12 several times during the printing of a multicolor composite image.

Medium 14 is driven in either direction along path 13 by drive roller 16 with tension drive means applied to medium 14 in path 13 via forward tension roll 18 and also at medium roll 12, which is also tied to tension drive means. These tension drive means assist in maintaining tightness on medium 14 in its reciprocal travel in path 13. With lid 11 in its closed position, stationary bars 21A, 21B and 21C supported in lid 11 aid in guiding medium 14 along path 13 for proper passage over encoder 20, through recording station 19, across development station 21 and thence over forward tension roll 18. Encoder 20, over which the medium 14 rides, provides a tracking signal used to sequentially position rows of latent imgage dots formed by electrodes 17 on the surface of medium 14 using conventional techniques. Optical sensor 23, which is a photodetector, is also included in path 13 to locate a dark mark on the section of medium being printed to establish a starting point for recording and printing of component color images and assure proper alignment in their superpositioning on the medium surface. At recording station 19, electrostatic head 22 contains a linear array of writing nibs 15 with adjacent rows of complementary electrodes 17 extending across the width of head 22 and, therefore, the width of medium 14. These nibs 15 may each be controlled individually or in a multiplexed manner to create areas of electrostatic charge on the surface of medium 14 as a medium section is moved forward along path 13 forming a latent electrostatic image. Because of the high accuracy and resolution obtainable with these nibs, such as, 400 nibs to the inch or greater, printer 10 has top level utility as a graphics plotter. Pressure pad 24 supported in printer lid 11 holds medium 14 against the surface of head 22.

When the development of an image on medium 14 has been completed at development station 21, the printed length of medium 14 is advanced and cutter 26 cuts medium 14 to permit its removal from printer 10. Cutter 26 includes a cutting blade arrangement and a cam operated device to rotate one blade relative to the other for one revolution. The shaft of the rotated blade includes a cam 300 having an offset 302. Roller 308 moves along the surface of cam 300 as cam 300 rotates in a counterclockwise direction, when viewing FIG. 1. Roller 308 is removed from offset 302 by means of outward movement of spring biased bell crank arm 310, which has its connected to plunger 312 of solenoid 314. A more detailed description of this cam operated device appears later in this description relative to FIGS. 12 and 13.

Head 22 may be transferred in a direction normal to the direction of medium movement or path 13 in order to align head 22 is a predetermined manner relative to the edge of medium 14. This predetermination is based on the desired amount of distance between the medium edge and the edge of the image to be place on its surface. This lateral translation is carried out by means of stepper motor 250 (FIG. 11A) supported on printer side frame 44 and coupled to move head 22 in a lateral direction on linear support bearings 22A supported on rods 22B, which are supported from the printer side frames 42 and 44. Also included along path 13 is a combination light diode and phototransistor sensor 22C fixed to head 22 and centered over the medium edge for detecting the edge of medium 14 as it is moved along path 13. Thus, motor 250 translate head 22 according to the sensed medium edge.

The forward end of lid 11 supports pinch rolls 18A which are resiliently mounted to the underside of lid 11 by spring supports 18B. When lid 11 is closed, rolls 18A will engage medium 14 against the surface of forward tension roll 18 and thereby grip medium 14 between the rolls so that forward tension can be maintained on medium 14, Drive roll 16 is a differential drive roll well known in the art and also has pinch rolls 288 which engage the surface of medium 14 as it passes over roll 16. Engagement is brought about by activation of solenoid 290 which pulls its plunger 294 downwardly to cause arm 292 to rotate clockwise, when viewing FIG. 1, around pivot point 296. The gripping action of rolls 288 ensures that no slippage occurs relative to medium 16 when drive roll 16 is operated to move the medium forward or rearward in path 13.

The above described features of printer 10 are generally conventional for electrostatic printers. Also shown in FIG. 1, however, is a development station 21 comprising a carousel 30, which consists of a rotating support on which toner or development units 32, 34, 36 and 38 are mounted. Conventionally, the toner units of an electrostatic printer are all arranged in a line, with each unit being elevated into contact with the passing medium during the printing of the toner in that unit. As a result, the length of the medium path must be considerably longer than in printer 10, the medium must be independently positioned relative to each unit, and the length of medium waste, represented by the length of medium between recording station 19 and printing station 21, is considerably longer. In contrast, carousel 30 brings each of the toner units 32, 34, 36 and 38 into the same printing position by rotating carousel 30, so that the medium path is relatively shorter and the medium engagement with each toner unit is the same for all units. The shorter medium path between stations 19 and 21 minimize decay time of image charge deposited on medium 14 at recording station 19 and reduces the amount of medium that needs to be dried for subsequent passage again through path 13. In FIG. 1, unit 32 is in printing position 31, while units 34, 36 and 38 are in other positions and will pass in rotary succession, as indicated by dotted line 30A, through printing position 31. In using this type of arrangement, only one set of drive motors is needed to operate all four toner units. Thus, a single toner pump motor and a single development unit roll drive motor (both to be discussed later) is all that is necessary for use with four toner units. These motors have mechanisms that come into engagement with appropriate driving elements on each unit when the unit is properly positioned at printing station 31.

FIG. 2 is a vertical cross sectional view through the center of carousel 30. Printer side frames 42 and 44 support hub members 46 and 48, respectively, by means of fasteners 50. Hub member 46 has a bearing support 52 on its inner end and a sun gear 54, which is in integral part of the enlarged portion of hub member 46. Hub member 48 has a bearing support 56 on its inner end. Carousel hubs 58 & 60 are rotatably mounted respectively on hub members 46 & 48 via their respective central cores 62 & 64. While core 64 is a cylindrical piece integral to hub member 48, core 62 is secured to hub member 46 by means of four feet members 61 forming openings 63 therebetween and through which the teeth of sun gear 54 are exposed, which best seen in FIG. 3. Cores 62 & 64 each have a longitudinally position key 66 protruding from their surfaces. Shaft 68, for coupling together carousel hubs 58 & 60, has corresponding mating slots 70 in each end of the shaft. The ends of shaft 68 slide over respective central cores 62 & 64 of hubs 58 & 60 with keys 66 positioned into slots 70. Thus, hubs 58 & 60 will rotate as a single unit about axis 67 of shaft 68 as rotatably mounted on fixed hub members 46 & 48.

Figure 11A:
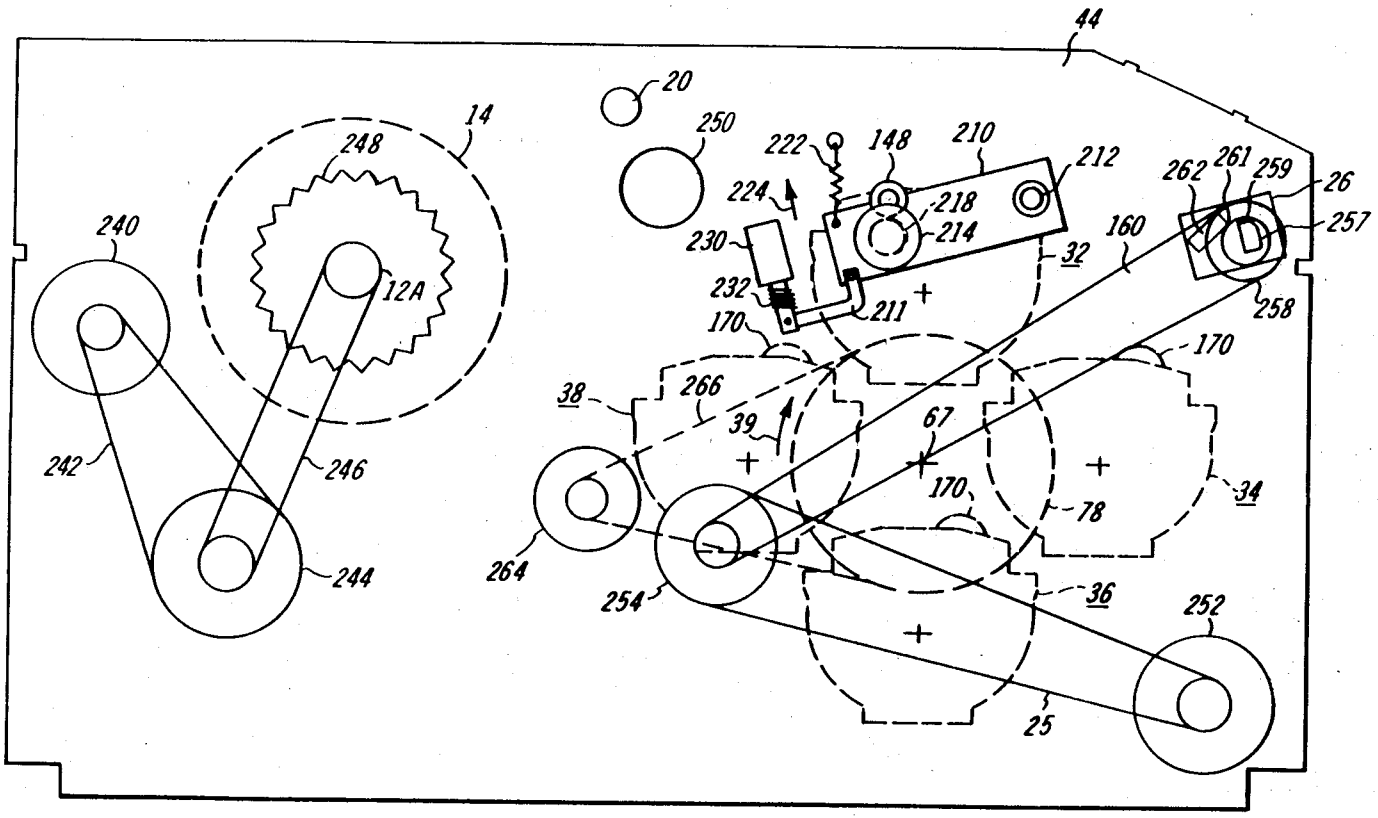
FIG. 11A is a schematic diagram of the driving components on the pump drive side of the printer of FIG. 1.

Carousel hub 60 includes four radially positioned studs 72, two of which are visible in FIG. 2. Resilient O-rings 55 are positioned on the bottom of studs 72. O-rings 55 provide for a tight fit of toner unit 32 between hubs 58 and 60 to prevent any lateral movement of unit therebetween. Studs 72 slidably receive axial support members 74 on one end of each toner unit 32–38. An axial opening 76 provided in the end of each member 74. As best viewed with the aid of FIG. 4, hub 60 also has on its outer surface a large ring gear 78 upon which a drive belt is mounted to rotate carousel 30 by means of stepper drive motor 264 (FIG. 11A).

Figure 3:
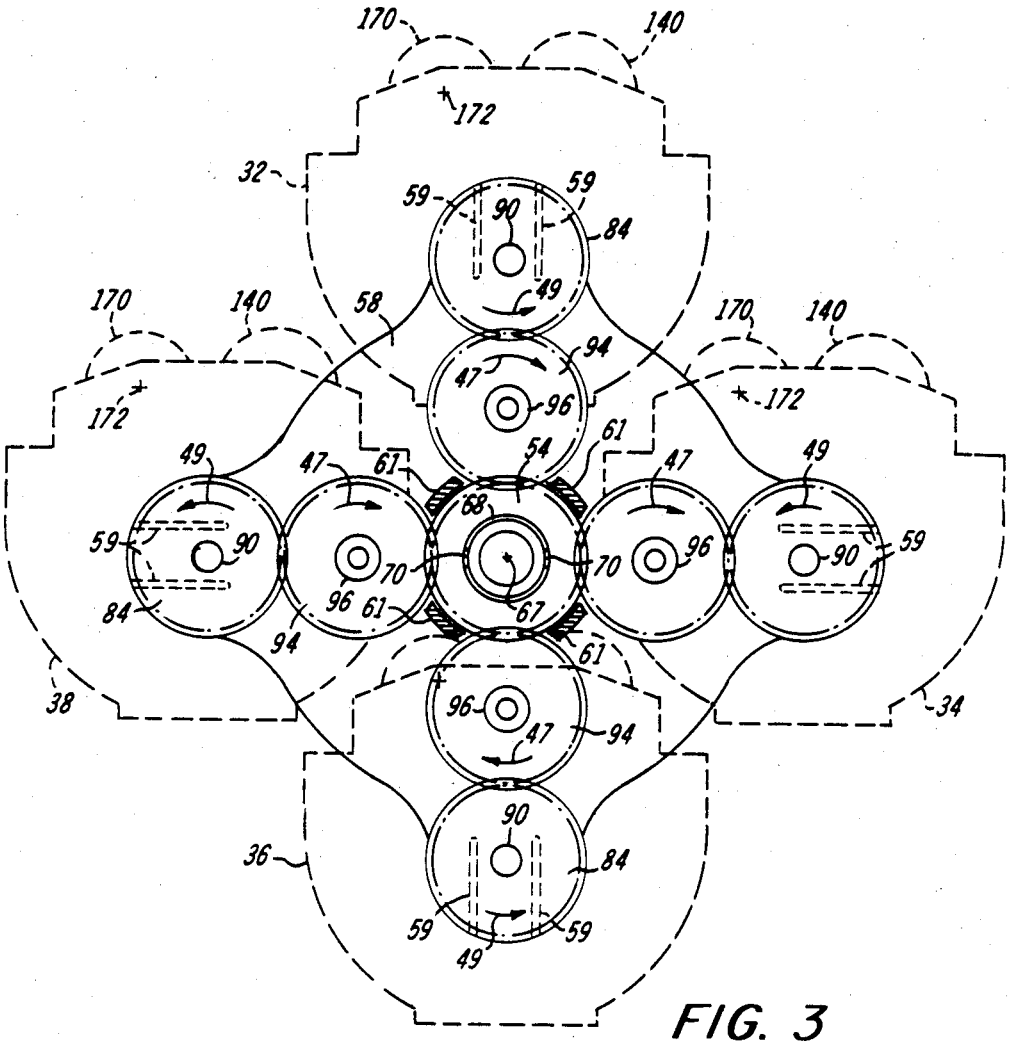
FIG. 3 is a cross section of the carousel taken along the line 3—3 in FIG. 2, showing the gear arrangement for aligning the toner units.

Carousel hub 58 includes four radially positioned apertures 80, two of which are visible in FIG. 2. The other end of each toner unit 32–38 is provided with axial support member 82 which includes gear 84 secured in fixed relation to member 82, which is integral to the toner unit. With reference now to FIG. 6A, axially aligned cavity 86 is provided in the end of member 82. Spring 88 is inserted in cavity 86 followed by plunger 90, which are held in cavity 86 by means of press fit socket 92. Thus, plunger 90 may be pressed into cavity 86 to permit its insertion into aperture 80 of hub 58 and upon release, will extend through aperture 80. Toner unit 32 may, therefore, be removed from between hubs 58 and 60 of carousel 30 by pressing in plunger 90 so that the unit may pass the inner surface of hub 58 and be lifted out of unit 32 upwardly along parallel ribs 59 on inner surface of hub 58 (FIG. 3). Ribs 59 function as sled tracks to reduce frictional engagement of the unit side surface with the inner surface of hub 58. With the lifting of this other end of toner unit 32 in this manner, unit 32 is then diagonally withdrawn from between hubs 58 and 60, removing support member 74 from stud 72 of hub 60. This removal action also squeezes unit 32 and its support member 74 against O-ring 55 to provide resiliency in performing this action. This compression of O-ring 55, together with hubs 58 and 60 being comprised of resilient plastic material, permits some lateral bending or give by the tops of hubs 58 and 60, as required, to permit the easy upward removal of toner unit 32 form between hubs 58 and 60.

The reverse process is followed for reinserting unit 32 between hubs 58 and 60. Support member 74 is placed diagonally first on stud 72 followd by lowering the other end of unit 32 to be in axial, parallel alignment with shaft 68. The alignment of plunger 90 with aperture 80 will permit its biased release into hub aperture 80. Thus, support member 74 act as a rotary support for one end of each toner unit 32–38 while plunger 90 acts as a rotary axial support for the other end of each toner unit 32–38.

An important aspect of this invention is the modularity of toner units 32–38 and their easy removal and insertion into carousel 30 without any concern for connection of the two drive means that couple to the toner unit when the latter is positioned in printing position 31. If a defective toner unit needs to be replaced, the unit is brought in position 31, printer 10 is turned off and the unit is replaced in seconds by an operator with a new unit without the need of a manufacturer's representative.

As best seen in FIG. 3 in combination with FIG. 2, fixed sun gear 54 on hub 46 is coupled in geared relation to each of the fixed toner unit gears 84 by means of the intercoupling of idler gears 94. Idler gears 94 are rotatably mounted on hubs 96. Thus, fixed toner unit gears 84 function as planetary gears. Since sun gear 54 and unit planetary gears 84 are fixed respectively to hub 46 and units 32–38, rotation of carousel 30, via drive gear 78, will cause idler gears 94 to rotate clockwise around run gear 54, as indicated by arrows 47 in FIG. 3, which, in turn, will rotate unit planetary gears 84 counterclockwise as illustrated by arrows 49. As a result, each of the toner units 32–38 will remain in an upright level position as illustrated in dotted lined in FIG. 3 since gears 54, 84 and 96 are all of the identical in size, number of teeth and diameter. In this manner, carousel stepper motor 264 can sequentially position each toner unit in a firm and level relation at printing position 31.

Mounted on the inner surface of side frame 42 is carousel index sensor 51 which is conventional light diode and phototransistor arrangement. A concentric ring 57 formed on the outside of hub 58 has a slot 53 formed in the ring. Sensor 51 is employed to detect the leading edge of slot 53 and this signal is used as a starting point for counting the steps made by carousel stepper motor 264. For example, toner unit 32 is shown in printing position 31 with sensor 51 at the leading edge of slot 53. There are known to be 450 steps per 90° of rotation from slot 53 in order to place the next toner unit 36 in printing position 31. Thus, there are a total of 1800 steps for one complete revolution of carousel 30. In this manner, control circuitry can call upon stepper motor 264 to move a predetermined number of steps to properly position any one of toner units 32–38 in position 31 at any time.

Figure 5:
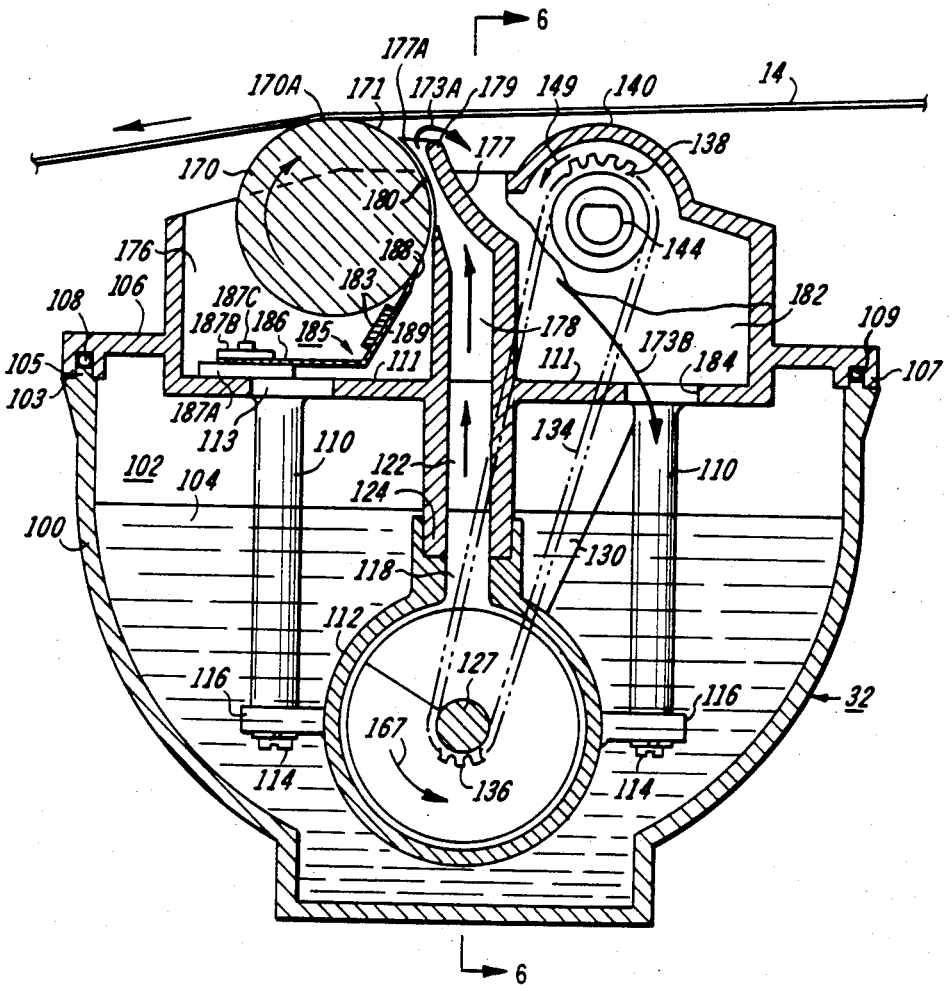
FIG. 5 is a lateral cross section of a toner unit taken along the line 5—5 in FIG. 2.
Figure 6:
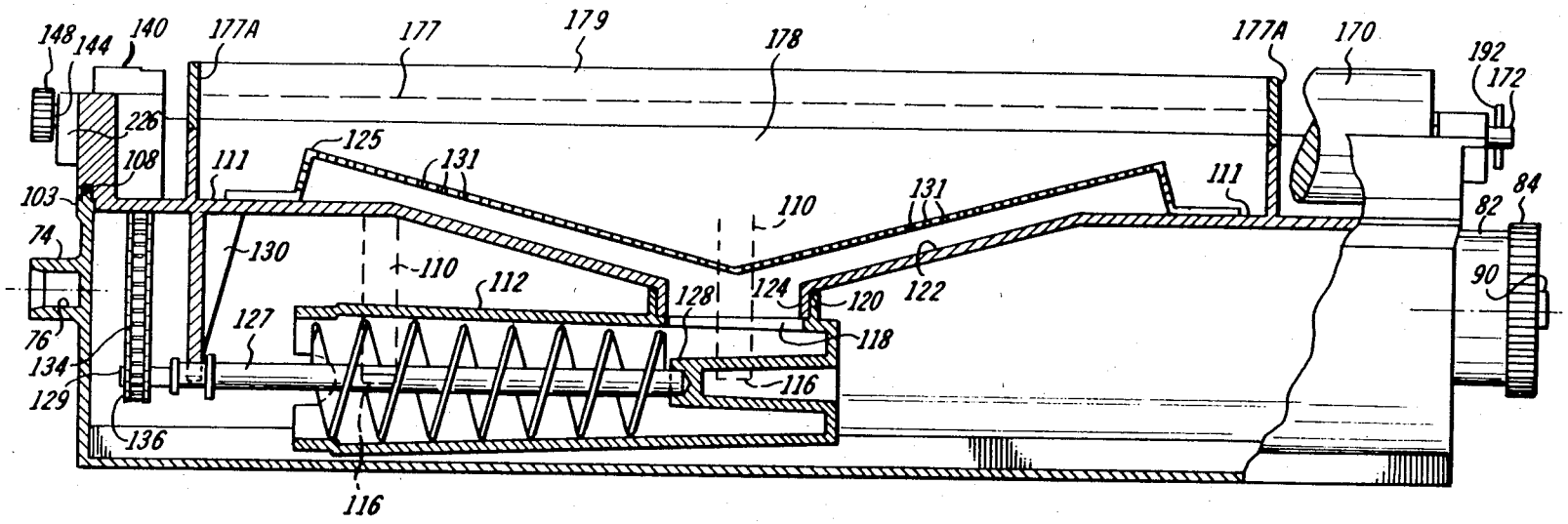
FIG. 6 is a longitudinal cross section of a toner unit taken along the line 6—6 in FIG. 5.
Figure 6A:
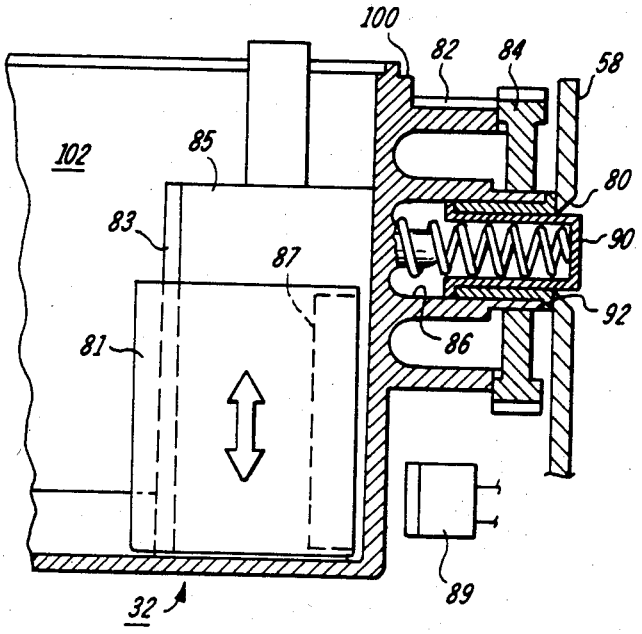
FIG. 6A is a detail of the cross section of FIG. 6, showing a retractable support for the toner units.

Reference is now made to FIGS. 5 and 6 for explanation of the details relating to toner units 32–38. The toner unit designation in FIG. 5 is unit 32, although it should be understood that the description is equally applicable to toner units 34, 36, and 38, which are all identical.

Toner unit 32 comprises a developer module having a lower housing 100 and upper housing 106. Lower housing 100 contain a cavity or chamber 102 for holding liquid toner 104. The top of housing 100 has a perimeter 103 with a perimetrical ridge 105. Upper housing 106 has a perimeter 107 with a perimetrical groove 109 in which there is an elastomeric seal 108. Perimetrical ridge 105 fits into perimetrical groove 109 compressing seal 108 to form a tight fluid seal between lower and upper housings 100 and 106. Suitable fastening means (not shown) are used to secure housings 102 and 106 together.

Figure 7:
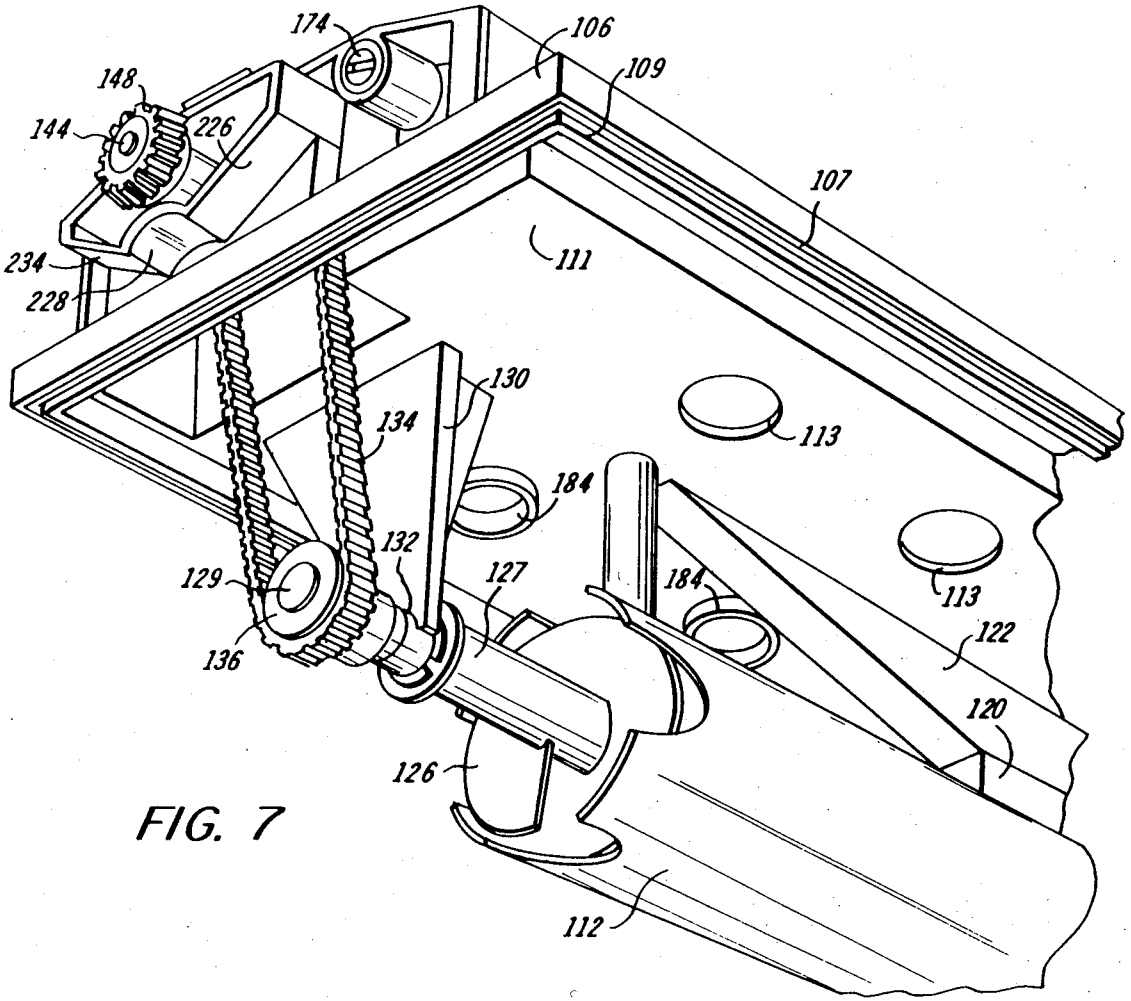
FIG. 7 is a partially cutaway perspective view of the toner pump system of the toner unit of FIG. 5.

Housing 106 has four downwardly depending pillars 110. Pump housing 112 comprises a cylindrical body with four extended tab members 116 aligned relative to pillars 110. Pump housing 112 is secured to the bottom of these pillars by suitable fasteners 114 via apertures provided in tab members 116. At the rearward extent of pump housing 112, there is a fluid outlet 188, best seen in FIG. 6, through which toner 104 is pumped. Pump outlet 118 is defined by sleeve 120 integral to pump housing 112. Sleeve 120 has a rectangular cross section. As shown in FIGS. 6 and 7, plenum 122, extending below the bottom 111 of upper housing 106, is provided with a lower extension 124 of mating rectangular cross section which tightly fits into the confines of sleeve 120. Within plenum 122 and supported from upper housing bottom 111 is a diffusion baffle 125 having a series of apertures 131 along its length as best seen in FIG. 6. The purpose of diffusion baffle 125 is to diffuse and disperse the liquid toner as it rises through plenum 122 under the force of auger 126 in order to provide a uniform flow of toner along the length of passage 178 for presentation at a development apex 171 formed between a developer/-wiper roll 170 and an upper end 179 of a deflection baffle 177, all of which will be described in greater detail later. The flow of liquid toner must be sufficient to establish a meniscus in apex 171 with the medium surface thereabove.

Figure 8:
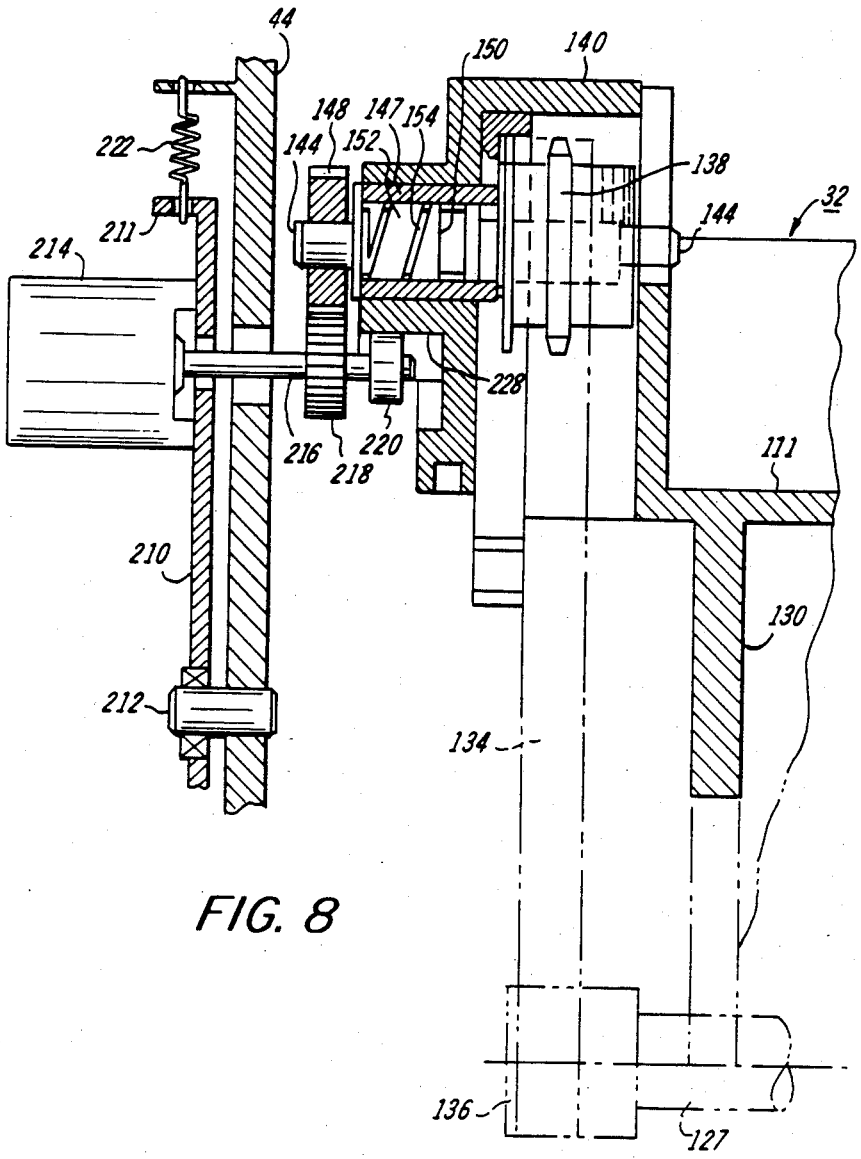
FIG. 8 is a detail cross section of the pump drive coupling for the toner units.

As best seen in FIGS. 6 and 7, an archimedean pump screw or auger 126 is rotatably supported within pump housing 112 via shaft 127. The inner end of shaft 127 is mounted in a bearing support 128 in housing 112 and the other end of shaft 127 is supported by plastic chain belt 134 and sprocket 136 secured to end 129 of shaft 127 in downwardly open cradle 132 formed on the end of pillar 130 extending down from housing bottom 111. As best seen in FIGS. 5 and 8, chain belt 134 is a closed loop belt operating between sprocket 136 and sprocket 138 secured to shaft 144 inside some portion 140 of upper housing 106. Shaft 144 is rotatably mounted in sleeve bearing 147 in dome portion 140. Shaft 144 within the confines of bearing 147 has an enlarged section comprising a slucer 150 which has a smooth bearing surface 152 for rotational movement with bearing 147 and a reverse spiral groove 154 formed in surface 152. By reverse, it is meant that groove 154 rotates in a direction spirally toward the inside of unit 32 when pump sprocket 138 is properly rotated in the the direction indicated by arrow 149 in FIG. 5. This inwardly augering action prevents any liquid toner 104 that has managed to escape from the inside of unit 23 along the surfaces between shaft 144 and bearing 147 from seeping out and directs the liquid toner back into the unit interior. At the other end shaft 144 relative to sprocket 138, there is secured gear 148 which is driven by external means to be explained in detail later.

The rotation of gear 148 drives sprocket 138 and sprocket 134, via chain belt 134, which, in turn, drives auger pump 126 in a counterclockwise direction when viewed from FIG. 5 and as indicated by arrow 167. Auger 126 fits loosely within the cylindrical confines of pump housing 112, as best seen in FIG. 6, which prevents any obstruction to the rotational operation of auger and also, importantly, permits the fluid toner to immediately and easily recede backward down through plenum 122, outlet 118 and thence through cylindrical pump housing 112 into chamber 102 after termination of the operation of the auger pump. The purpose of this function will be explained in more detail later.

With reference again in particular to FIGS. 2, 5 and 7, developer/wipe roll 170 with end shafts 172 and 174, respective shown in FIGS. 6 and 7, is rotatably mounted in the forward chamber 176 of upper housing 106 in suitable, bearing supports (not shown). Roll 170 may be comprised, for example of a steel roll with a polished chromium plated surface or may be a stainless steel surface with a polished surface. Roll end shaft 172 also includes the transverse pin 192 to form a T-coupling. T-coupling 192 is driven by servo motor 204 via its gear reducer 202 and claw coupler 190 shown in FIGS. 9 and 10, which will be described in greater detail later.

Referring again to FIG. 5, an elongated doctor blade 185 is secured to the bottom wall 111 of upper housing 106 along its lower portion 186 by its clamping between backer plate 187A and clamp plate 187B and secured in place with suitable fasteners 187C. Upper portion 188 of doctor blade 185 is biased into engagement along the length of roll 170 to wipe and scrape clean the surface of roll 170 of excess toner. Blade 185 may be of resilient metal material, such as half hard beryllium copper alloy, and is bent as shown to be biased against the surface of roll 170 when the latter is mounting on housing bottom 111. An acoustic resident damper 183, e.g. a thin strip of stainless steel plate, is mounted on central portion 189 of blade 185 to dampen the blade from chattering or vibrating on the surface of roll 170 when top portion 188 encounters solid particles on the roll surface or simply due to the rotational velocity of roll 170 into the forward edge of blade portion 188, particular when the blade edge has become worn down to a sharp point. Blade 185 also forms a fluid seal between the surface of roll 170 and blade portion 188 with excess toner being able to flow down to bottom 111 of chamber 176 and through outlets 113.

The two bends in blade 185 separating it into three portions 186, 188 and 189 allows for close tolerances of the blade corner edge against the surface of roll 170 and maintains the corner edge of the blade oriented against the surface of roll 170 over a greater range of tolerances.

As shown in FIG. 5, medium 14 is transported over unit 32 in a manner to engage the surface of roll 170 at point 170A. Roll 170 is rotated in a direction opposite to the direction of movement of medium 14. The engagement of medium 14 will roll 170 at point 170A preforms two major functions. The first function is that a seal is formed between moving medium 14 and the surface of roll 170 so that toner will not pass therebetween due to the action of the oppositely rotated roll 170. Thus, there is no toner gap formed between roll 170 and medium 14. As a result a development apex is formed at 171 wherein liquid toner 104 from auger pump 126 is presented via passage 178 and upper narrowing baffle 177 to form a toner meniscus on the under side of medium 14 adjacent the apex 171 and baffle top 179. Spent toner is thereafter forced to flow over the top and down the backside of baffle top 179, as indicated by arrow 173A, and down into rearward chamber 182 of upper housing 106 and thence through a series of apertures 184 into reservoir 102 of lower housing 100 as indicated by arrow 173B at this aperture.

The second function is that the leeward portion of the tangential engagement of medium 14 with the surface of roll 170 performs a wiping action on the surface of medium 14 to remove excess liquid toner and promote drying of the medium surface. This is particularly important from the standpoint that the medium section being imaged will be sequentially subjected to the creation of a series of component latent images, between creations of which the component color images are developed with a liquid toner. If the surface of the medium section is still wet when a subsequent latent is to be formed, the wet surface may cause shorting between the writing nibs damaging or destroying their functionality. Thus, this wiping action together with the use of forced air at 37 in FIG. 1 is fundamentally important to the operation of printer 10.

Additional details relating to the structure, function and operation of roll 170 are found in patent application Ser. No. 06/880,772 filed 7/1/86 which is incorporated herein by reference thereto.

It should be noted that once the development apex 171 has been formed and a meniscus created on the surface of medium 14 adjacent to the formed apex, the meniscus remains attracted to the medium surface after termination of toner pumping. It is desirable to remove this meniscus immediately to eliminate any toner stains or marks on the passing medium created by this residual meniscus. There is a two fold function for breaking up this mensicus as quickly as possible. First, it is desirable that toner present in passage 178 and apex 171 be quickly removed. Since auger 126 is loosely filled within pump housing 112, the termination of rotation of auger 126 will permit the pressure wall of liquid toner created in plenum 122 and passage 178 to collapse immediately so that toner will drain quickly due to gravity down through pump housing 112. Also, at each end of baffle 177, there are radial openings 180 (FIG. 5) between the surface of roll 170 and the end 177A baffle 177 so that liquid toner can immediately escape from development apex 171 via radial openings 180 into chamber 176 upon termination of pumping. Openings 180 are not so large as to interfere with the uniform delivery of toner along the length apex 171 since the volume delivery of toner per unit time greatly exceeds the flow of toner through openings 180 during toner pumping.

Second, the wiping action of roll 170, which continues to operate after termination of toner pumping, will also immediately sweep away the meniscus at apex 171 as medium 14 continues to move forward in the direction indicated in FIG. 5, forcing, in part, the toner meniscus to be expelled out of openings 180 and down passage 178.

As an example of an exemplary embodiment, radial openings 180 may be in the range of 0.005 to 0.010 of an inch. The width of development apex 171 from baffle top 179 to the surface of medium 14 may be in the range of 0.05 to 0.150 of an inch. The distance between the inside surface of baffle top 179 and the surface of roll 170 adjacent baffle top 179 may be in the range of 0.04 to 0.10 of an inch. However, it has been determined that these ranges are not critical, as changes can be made to these limits in relation to each other and still provide a functional development unit. Important aspects to consider are that if the width of development apex 171 from baffle top 179 to the surface of medium 14 is too large, the meniscus with the medium surface above apex 171 will never be established. If this width is too narrow, the established meniscus will be difficult to break up upon toner pump termination, raising the possibility of staining the medium surface with excess toner.

As previously indicated, additional drying of the medium surface is accomplished by use of a blower or fan located in the bottom of printer 10 (not shown) to direct air, as indicated by arrow 37 in FIG. 1, on the surface of medium 14 as its exits from development station 21.

Toner 104 in reservoir 102 is replenished by the printer operator when an indication is given at the control panel of printer 10 that the toner level in reservoir 102 is low. This low level indication is provided by block shaped floater 81 shown in FIG. 6A. Floater 81 is a hollow sealed plastic container with vertical side grooves that engage corresponding vertical flanges 83 (one shown) of frame 85 supported within reservoir 102. Thus, floater 81 may move vertically within reservoir 102 between opposed flanges 83 of frame 85 but cannot be removed from between these flanges without removal of upper housing 106 from lower housing 100. Floater 102, therefore, will float in liquid toner 104 present in reservoir 102 and will move downwardly into the reservoir as the liquid toner is depleted.

Floater 81 also includes a vertical slot on the surface thereof that faces toward hub 58. Positioned in this slot is permanent magnet 87. As the level of liquid toner receeds due to its depletion, the magnetic field of magnet 87 will drop lower into reservoir 102. Toner unit 32 in FIG., 6A is shown in its path of rotation in close proximity to magnetic reed switch 89. This happens to be at the bottom position of carousel rotation 180° from printing position 21 but, of course, the toner level may be checked at any position along the path of the carousel rotation. When unit 32, or any other unit 34, 36 or 38 for that matter, is in printing position 31, and floater 81 is sufficiently low within reservoir 102 due to a low level of liquid toner 104, the magnetic field magnetic 87 will influence reed switch 89 and open its contacts and provided an indication at the printer control panel that the toner level for the particular toner unit involved is possibly too low to complete the development of a subsequent component image to be formed and that additional toner should be supplied to the deficient toner unit before proceeding further.

Reference is now made to both FIGS. 8 and 11A to describe details relating to the motorized drive mechanism for driving auger pump 126. Supported on side frame 44 is a bracket 210 pivotally secured to frame 44 at pin 212. Secured at the other end of bracket 210 is pump drive motor 214. The output shaft 216 of motor 214 has gear 218 secured adjacent to its outer end. Bearing roller 220 is secured at the outer end of shaft 216. Motor 214 may, for example, be a 1/20 horsepower capable of rotating auger 126 1,000 rpm.

Figure 4:
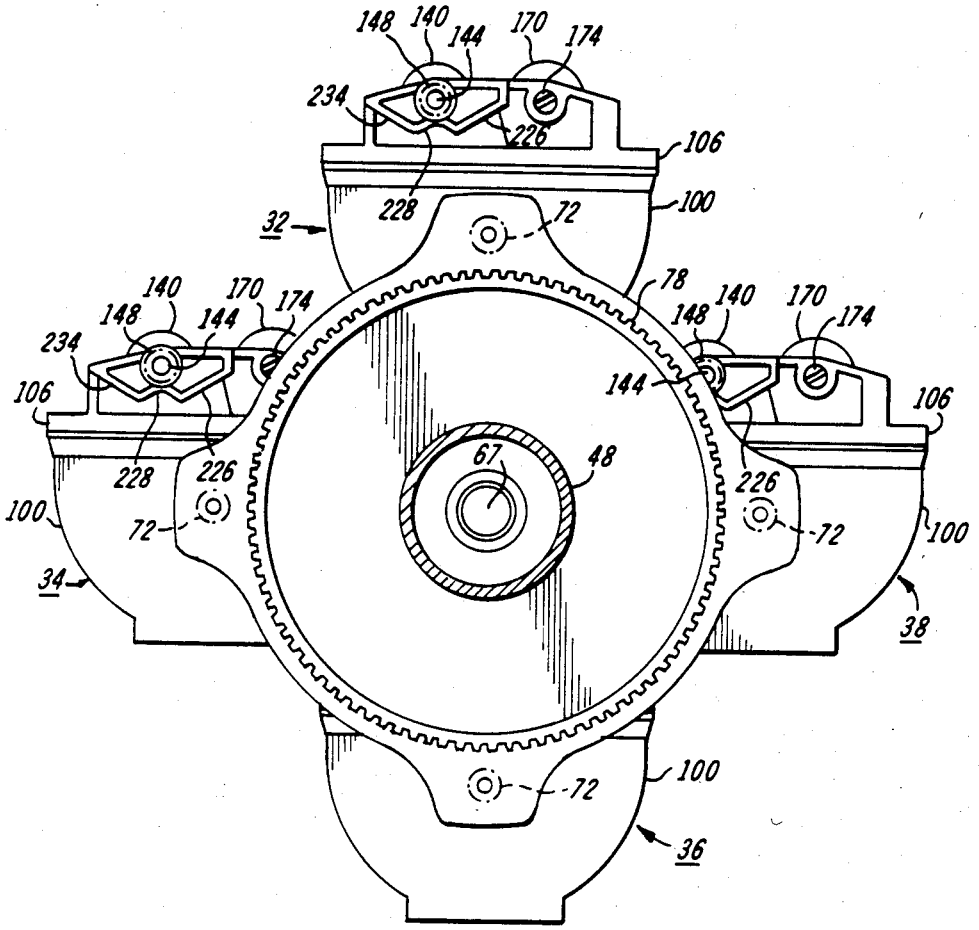
FIG. 4 is a cross section of the carousel taken along the line 4—4 in FIG. 2.

As shown best in FIG. 11A, bracket 210 is biased by spring 222 to pivotally move bracket upward in the direction of arrow 224 to bring gear 218 into teeth engagement with gear 148 of a toner unit positioned in printing position 31. However, gears 148 and 218 are held from initial engagement, particularly when carousel 30 is in the process of positioning a toner unit in printing position 31, by means of roller 220 initially engaging cam surface 226 on toner unit 32, as best shown in FIGS. 4 and 7. This action moves bracket 210 down in a direction opposite to arrow 224 ensuring no preengagement of gears 148 and 218. Roller 220 will ride along surface 226 as carousel 30 is moved forward as indicated by arrow 39 in FIGS. 1 and 11A and finally reach and slip into cavity 228 under the tension of spring 222 as illustrated in FIG. 8. At this point, carousel 30 stops rotational movement having moved a predetermined number of steps as previously discussed relative to FIG. 2. The positioning of roller 220 in cavity 228 helps to stabilize the positioning of the toner unit at printing position 31. Also, at this time, solenoid 230, with its plunger 232 connected to a arm 211 fixed to bracket 210 as shown in FIG. 11A, is activated to pull bracket 210 upwardly in the direction of arrow 224 to firmly engage the operation of gears 148 and 218. Motor 214 may now be operated to drive gear 148 and thence drive chain belt 134 and auger pump 126 in the manner previously described.

When carousel 30 is again to be operated in the direction of arrow 39, solenoid 230 is initially deactivated. Upon operation of stepper motor 264, roller 220 on motor shaft 216 will ride up on cam surface 234 (FIGS. 4 and 7) against the force of spring 222 (FIG. 11A) and ensure disengagement of gears 148 and 218 as the toner unit is moved out of printing position 31.

Figure 9:
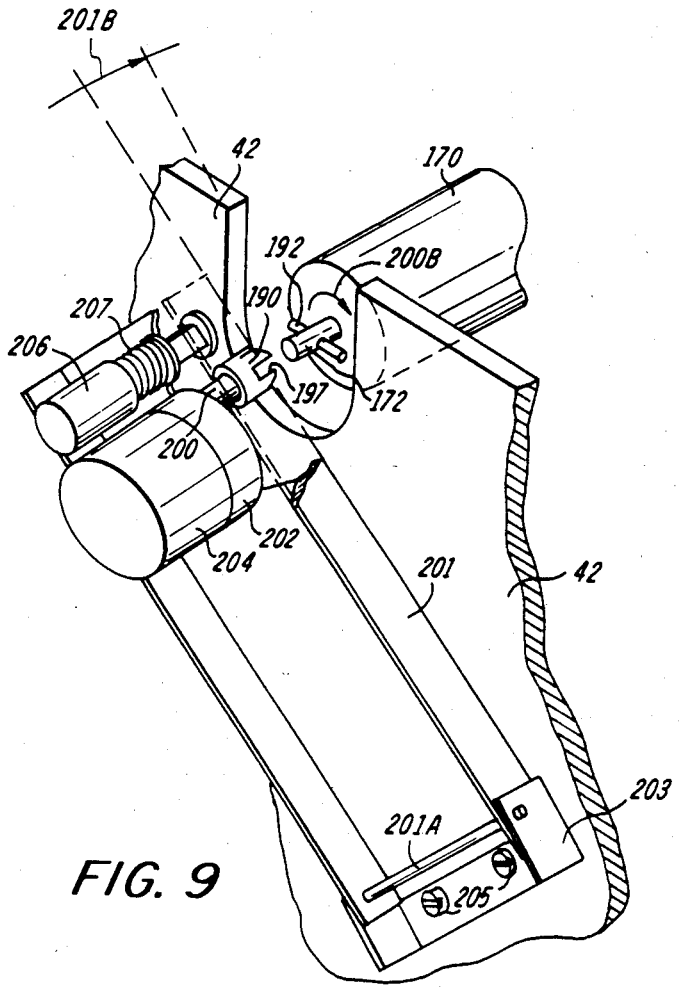
FIG. 9 is a perspective view of the motorized drive coupling for the developer/wipe roll of toner unit.
Figure 10:
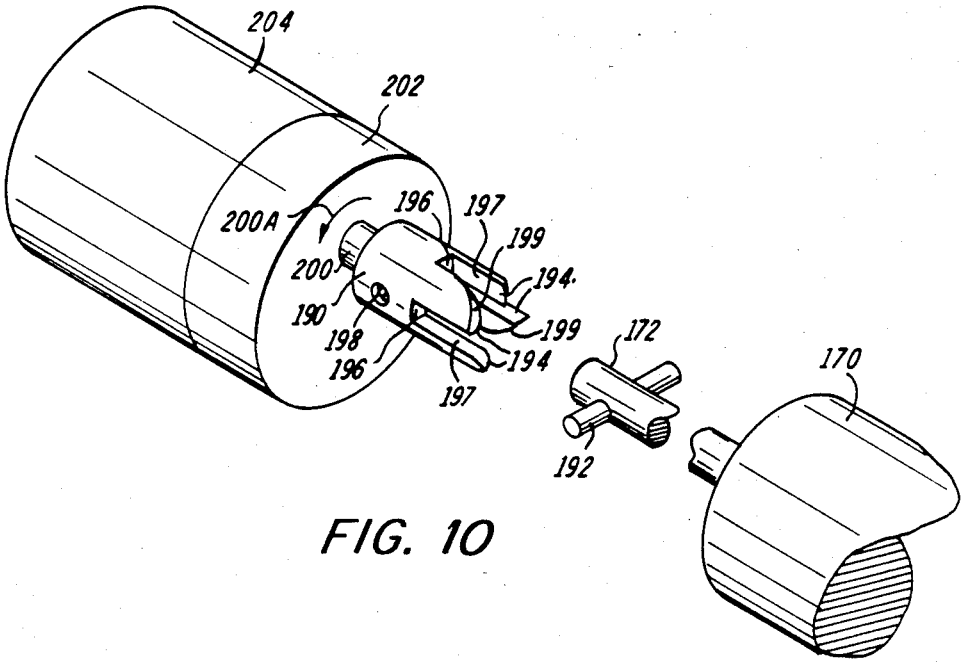
FIG. 10 is an exploded perspective elevation to show the details of the coupler prong of the drive coupling of FIG. 9.
Figure 11B:
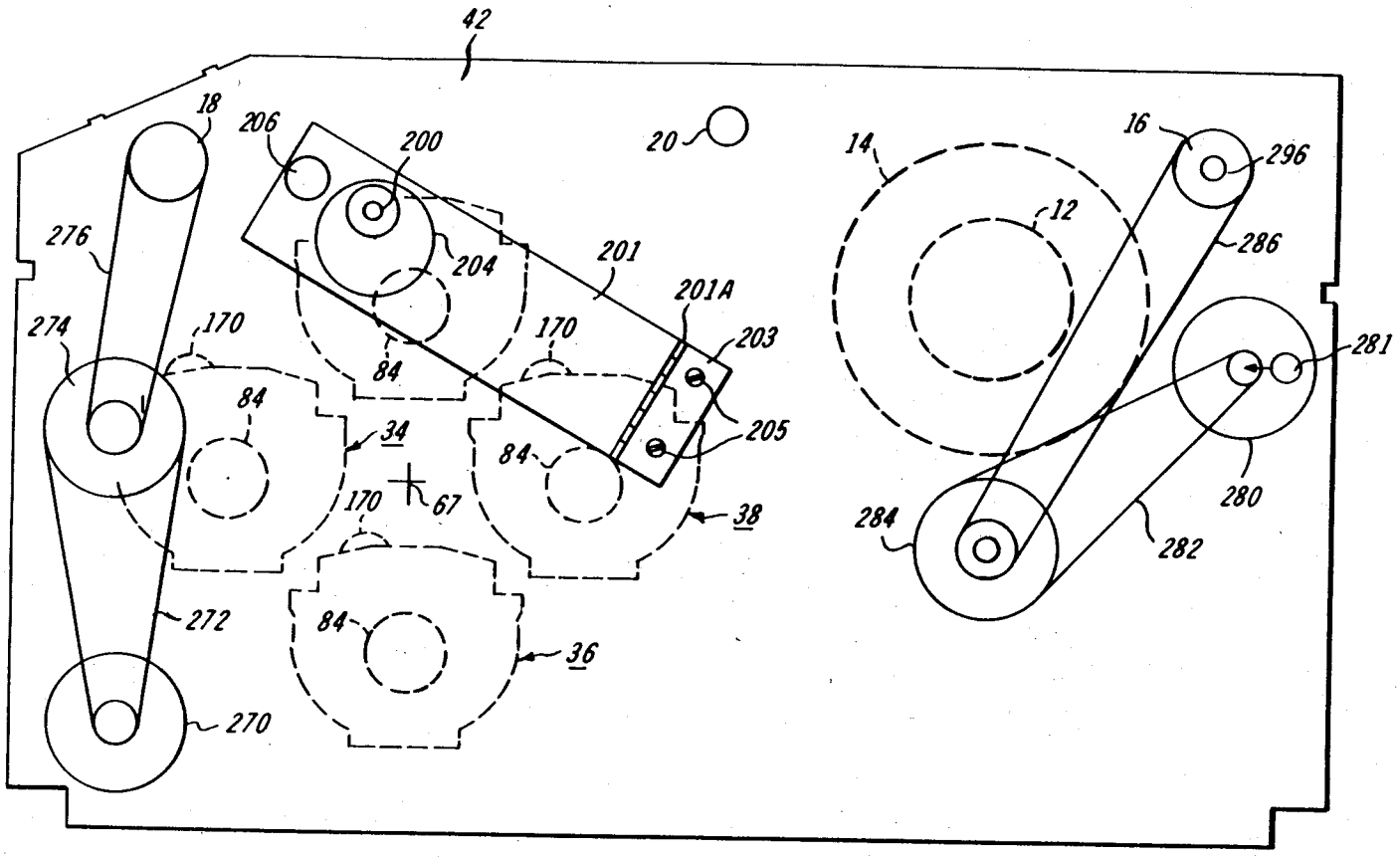
FIG. 11B is a schematic diagram of the driving components on the roller drive side of the printer of FIG. 1.

Reference is now made to FIGS. 9, 10 and 11B to describe details relating to the motorized drive mechanism for driving roll development/wiper roll 170. Supported on side frame 42 is a bracket 201 pivotally mounted to bracket support 203 at 201A. Bracket support 203 is secured to side frame 42 by means of suitable fasteners 205. Mounted on the outer end of bracket 201 is solenoid 206 with the outer end of its plunger 207 secured to frame 42. Mounted adjacent to solenoid 206 is motor 204 and its integral gear reducer 202. Eccentrically mounted output shaft 200 from gear reducer 202 is connected by pin 198 to claw coupler 190. Coupler 190 has four claws 194 on its outer end separated by orthogonal grooves 196. As best shown in FIG. 10, each claw 194 has two unique side surfaces. Forward surface 197 of each claw 194 is flat and substantially parallel to the axis of shaft 200. The leeward surface 199 is convex shaped, curved surface.

As may be understood from an examination of both FIGS. 9 and 10, when a toner unit is in printing position 31, solenoid 206 will be activated to pull its shaft 207 into the solenoid thereby moving bracket 201 in the direction of arrow 201B toward side frame 42, as illustrated in FIG. 9. This action will bring claw coupler 190 into engagement with T-coupler 192. If the position of pin 912 is not properly aligned to be received within a groove 196 of claw coupler 190, leeward surfaces 199 of claws 194 will engage pin 192 and guide by rotating shaft 172 into one of the grooves 196 as the claw coupler 190 is brought into engagement with T-coupler 192. In other words, claw curved surfaces 199 guide transverse pin 192 properly into grooves 196 as claw coupler 190 is moved toward T-coupler 912. Once solenoid 206 has positioned bracket 201 substantially flush with side frame 42, claw coupler 190 will be fully engaged upon T-coupler 192. Operation of roll motor 204 will rotate output shaft 200 in the direction of arrow 200A in FIG. 10 bring flat sides 197 in engagement with the pin 192 and rotate roll 170 in the same direction, as indicated by arrow 200B in FIG. 9, which direction is opposite to the direction of medium movement.

Reference is now made to FIGS. 11A and 11B to complete a general description of all motorized drive units functional to the operation of printer 10 to better understand and explain the operation of printer 10 in connection with carousel 30. In FIG. 11A, leeward tension servo drive motor 240 is coupled via belt 242 to reduction pulley 244 which, in turn, is coupled via belt 246 to shaft 12A of medium roll 12. The gear reduction ration between motor 240 and shaft 12A is about 10:1. Also secured to shaft 12A is tooth wheel 248 which is utilized with optical sensing means to determine when medium 14 is low or has run out. A detail description of the operation and functional use of wheel 248 is found in patent application Ser. No. 06/880,767 filed 7/1/86.

Stepper motor 250 in FIG. 11A is employed to translate recording head 22 transversely in path 13 of medium 14 in order to laterally position the head relative to the sensed edge of medium 14 via sensor 22C so that the composite component color images will be properly aligned relative to one another in the medium lateral direction during subsequent passed of the same medium section through printer 10. Thus, each component color image is aligned in the lateral direction relative to same medium section by lateral positioning of head 22 relative to a moving edge of medium 14 and each component color image is aligned to begin at the same longitudinal point on the medium section by locating a dark mark previously printed on the medium section during its first pass through printer 10 to establish the starting point for recording and subsquently printing of each component color image. The dark mark is located by optical sensor 23 during forward medium movement. These orthogonal alignment techniques for component color images to produce a high resolution composite image is accomplished without the need of the more elaborate tracking scheme disclosed in U.S. Pat. No. 4,569,684 because (1) the width of the paper medium intended for use in printer 10 is 11 inches wherein in the printer disclosed in this patent, the medium was generally much wider, such as 36 inches or 42 inches. The greater width in medium brings about greater tendency for the medium to expand and contract while being transported through the printer several times. In other words, the medium of 11 inches width is not wide enough to necessitate medium shrinkage or expansion compensation. (2) The length of medium path 13 is much smaller in printer 10 compared to previous color printers due largely to the utilization of carousel 30 so that it is not necessary that component color development units be laid out in series along the medium path as shown in U.S. Pat. No. 4,569,584. As an example, the path length between head 22 and a toner unit development/wipe roll 170 at printing station 21 is only about 6 inches, which, of course, remains the same for each toner unit so positioned in printing position 31. In color printers having a linear array of development units, the paper length between the electrographic head and the last development unit may be as much as three feet. With the shorter medium path and narrow width medium, the precision adjustment system of U.S. Pat. No. 4,569,584 has been found not necessary in printer 10. As a result, the shorter path length between the electrographic head and the development unit at printing position 31, which represents the amount of medium waste for each medium section printed or plotted, is reduce significantly.

Paper cutter stepper motor 252 is coupled to reduction pulley 254 via drive belt 256 which in turn, is coupled to paper cutter 26 and its cutter bar pulley 258 via drive belt 260. Rotation of stepper 252 will rotate cutter bar 257 to engage its cutting edge 259 with the cutting edge 261 of stationary bar 262.

Stepper carousel motor 264 rotates in step fashion carousel 30 via its ring gear 78 by means of drive belt 266.

In FIG. 11B, forward tension servo drive motor 270 is coupled via belt 272 to reduction pulley 274 which, in turn, is coupled via belt 276 to forward tension roll 18. The gear reduction ratio between motor 270 and roll 18 is about 10:1. Medium servo drive motor 280 is coupled via belt 282 to reduction pulley 284 which, in turn, is coupled via belt 286 to differential drive roll 16. The gear reduction ration between motor 280 and drive roll 16 is about 17:1. As mentioned previously relative to FIG. 1, drive roll 16 includes in combination a pinch roll 288, the surface of which engages the surface of drive roll 16 upon activation of solenoid 290 which moves bell crank arm 292 downwardly via its plunger 294 about pivot point 296. Medium velocity encoder 281 is attached to the shaft drive motor 280 and functions to provide feedback data to a speed servo (not shown) for the purpose of precisely determining the velocity of the motor. In this connection, the speed of motor 280 may be varied to vary the velocity of medium 14 through path 13 dependent upon how much data is present in the printer data buffers for presentation at head 22. If the data buffers are full, the speed servo will drive medium 14 at a maximum velocity while a speed servo (not shown) associated with encoder 20 will supply the data to head 22 at a rate to match the medium velocity. However, the speed servo for encoder 281 will slow down medium velocity with a corresponding slow down in presentation of data to head 22 via the speed servo for encoder 20, the amount of decrease or slow down being dependent upon how much data is left in the data buffers. For example, if the data buffers are full, the medium velocity is 2.5 ips. If the data buffers are about 80% empty, the medium velocity is 0.4 ips. Any lower status than this will cause the medium velocity to be terminated, as it is not desirable to run out of data supplied to head 22 during the formation of an imaging because a blank space will appear in the resulting image. Encoder 281 is also employed to measure the length of medium paid out over roll 16 in either direction of movement in path 13.

In operation of tension motors 240 and 270 relative to drive motor 280, it should be understood that drive motor 280 is a reversible direct current motor and with the operational aid of pinch roll 288, drives medium 14 in either direction in path 13. The function of tension motors 240 and 270 is to apply tension on the medium in path respectively in opposite directions to each other. When motors 240 and 270 are first activated, current is applied gradually, via pulse width modulation, so that tension is initially applied to the medium in a gradual manner. Motors 240 and 270 are DC current motors and since current is roughly proportional to torque, these motors maintain a predetermined amount of torque in opposite directions on medium 14 in path 13 and thereby maintain substantially uniform linear control of medium movement through path 13 with minimal lateral digression in that path during such movement.

Figure 12A:
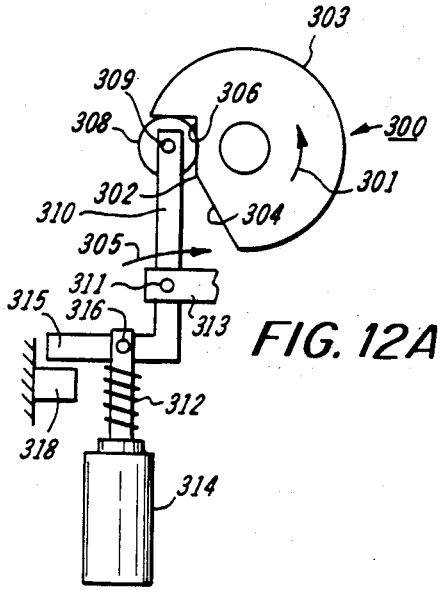
FIGS. 12A, 12B and 12C illustrate the operation of the printer paper cutter solenoid and cam.
Figure 12B:
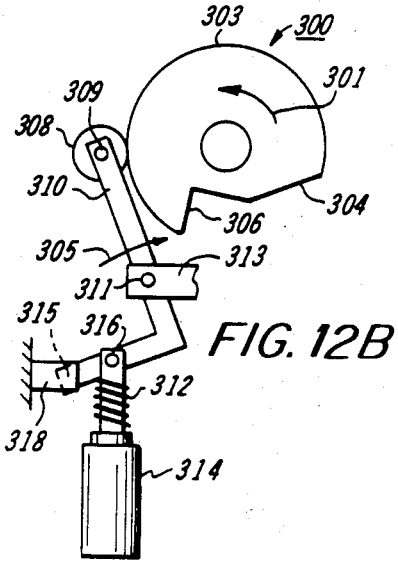

Reference is now made to FIGS. 12A, B and C to explain in more detail the operation of the cutter device previously alluded to relative to FIG. 1. As shown in each of these figures, bell crank arm 310 is pivotally secured at 311 to member 313 which is secured to side frame 44. Thus arm 310 is allowed to rotate as shown in FIG. 12B but is biased to rotate toward cam 300 by means of a spring (not shown), illustrated by arrow 305. The lower portion of arm 310 is pivotally secured at 316 to plunger 312 of solenoid 314. The upper position of arm 310 rotatably supports roller 308 on pin 309. The end portion 315 of arm 310 is used as a flag that interrupts the beam between the light emitting diode and photodetector of optical sensor 318. Sensor 318 is the same as sensor 51 in FIG. 2.

Figure 12C:
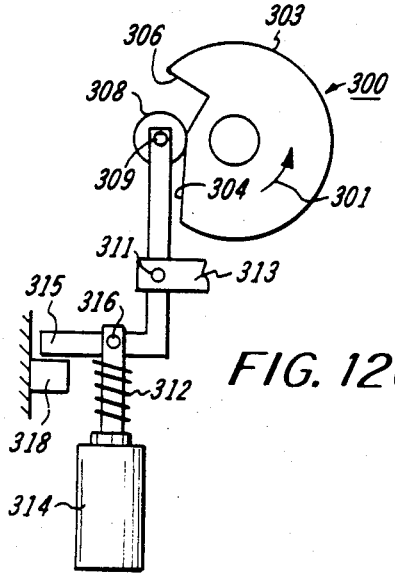

Cam 300 is fixed to the same shaft that includes cutter pulley 258. Surface of cam 300 is substantially circular at 303 except for offset 302 which comprises beveled surface 304 and right angle step surface 306. Servo motor 252 rotates cam 300 in the direction indicated by arrow 301. However, cam 300 cannot continue to rotate in this direction unless roller 308 and arm 210 are removed from step 306 with the aid of solenoid. This is illustrated in FIG. 12B wherein solenoid 314 has been activated, pulling arm 310 downwardly via plunger 312 so that step surface 306 has been freed of roller and cam is able to rotate in direction 301. As soon as roller 308 begins to roll along surface 303, solenoid 314 is deactivated and roll 308 maintains engagement with surface 303 due to the spring force represented by arrow 305. It is to be noted that when roller is riding on surface 303, flag 315 will interrupt the beam of sensor 318. However, as cam 300 continues to rotate, roller 18 will move onto surface 304 permitting arm 210 under the influence of spring force represented by arrow 305 to return arm 310 to its original upright position as illustrated in FIG. 12C.

Figure 13:
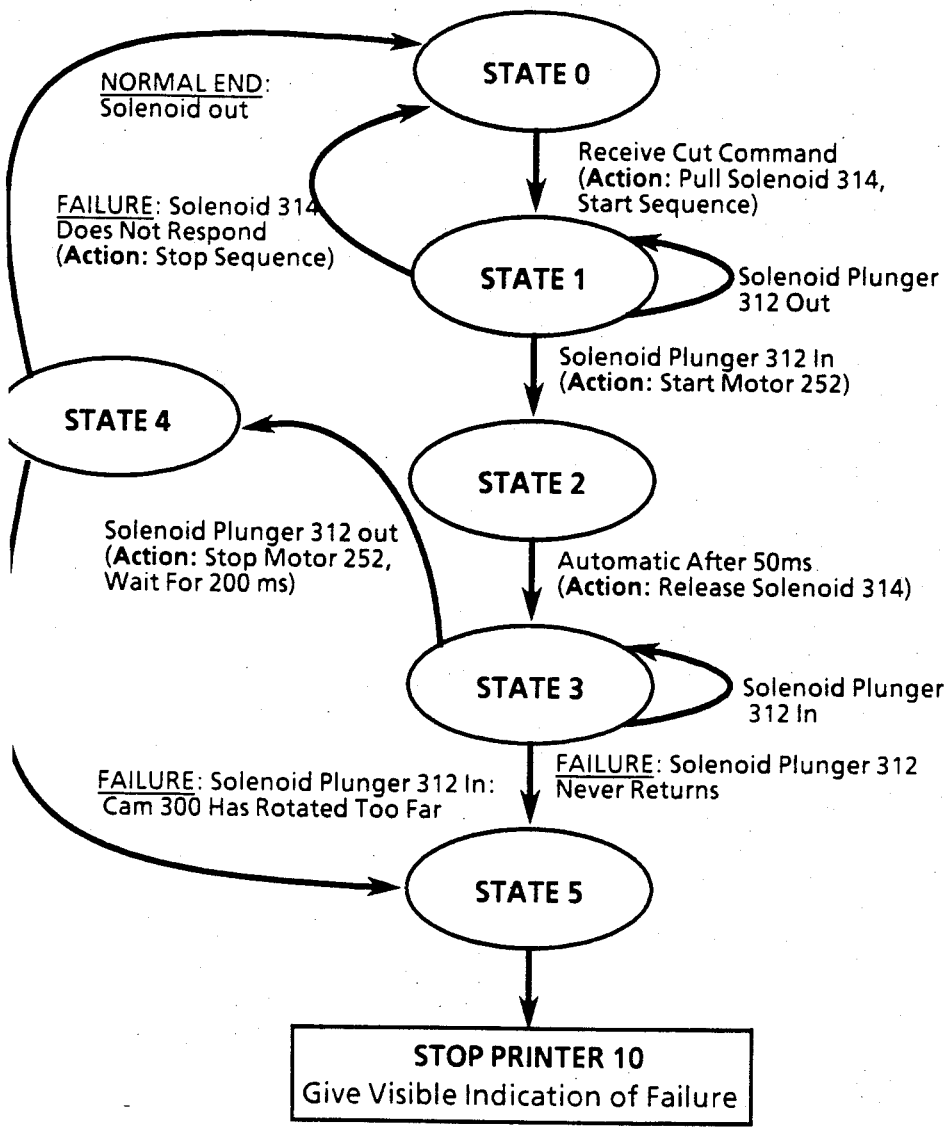
FIG. 13 is a state diagram for explaining the operation of the printer paper cutter solenoid and cam of FIGS. 12.
Figure 14:
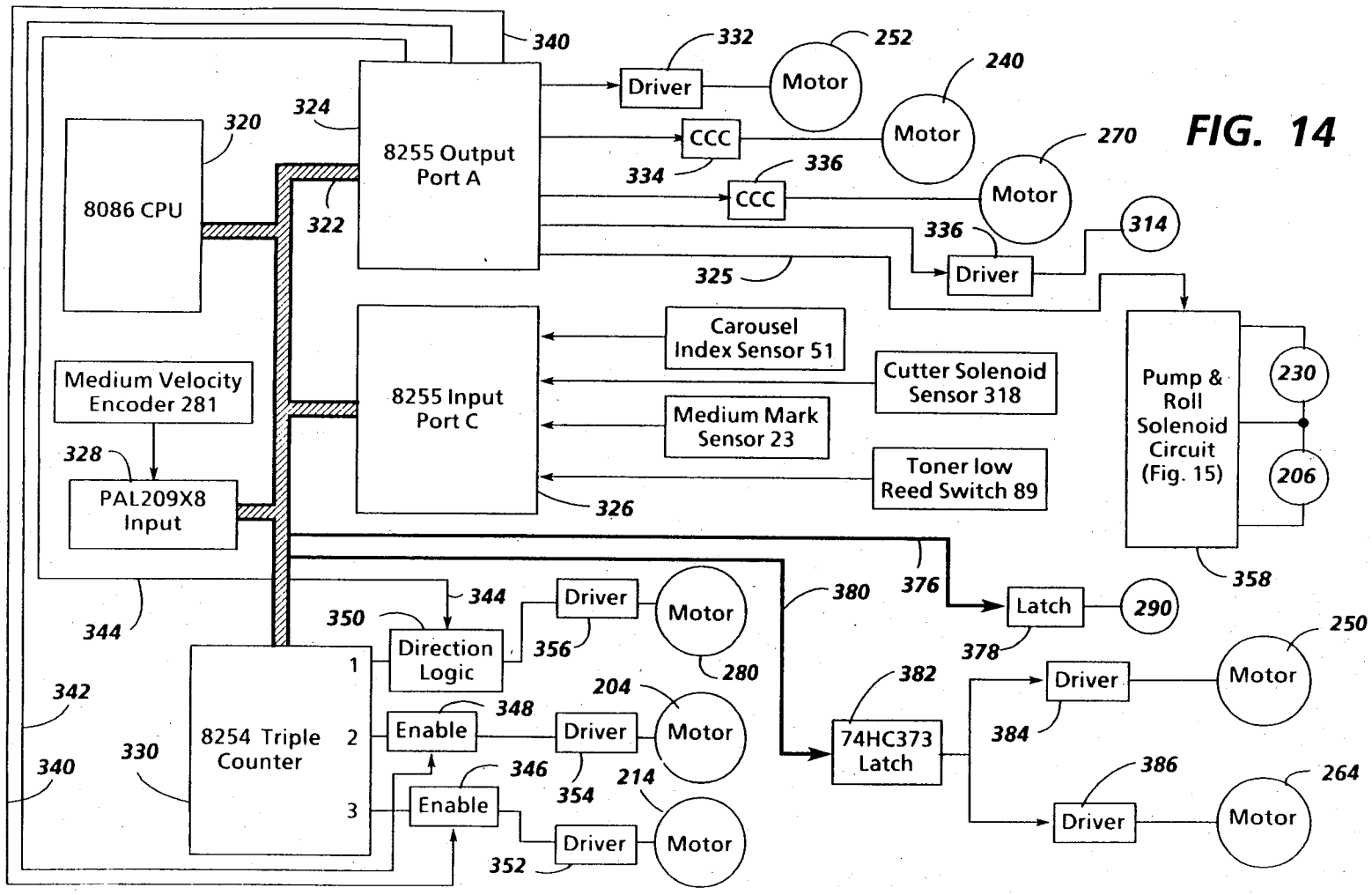
FIG. 14 is a schematic diagram showing the control circuitry for the driving components of FIGS. 11A and 11B.

The operation of the cutter devive shown in FIG. 12 is illustrated relative to the state diagram shown in FIG. 14. Each state in FIG. 13 represents a condition where an event is expected and continuous polling is conducted to see if the event has occurred. There will be two or more events, but only one event can occur. The transition between states is where an observed action takes place.

In State 0, the control logic is polling a cut command to sever medium 14 extended beyond the point of cutter 26. Upon receipt of this command, solenoid 314 is activated to rotate arm 310 in the position illustrated in FIG. 12B. Also, the sequence for carrying out the cutting operation is enabled. At this point State 1 has been achieved, If solenoid 314 has not responded for any reason over a long sequence of polling, a failure is noted the cutting sequence is terminated to State 0.

In State 1, the event polled is a determination of whether solenoid plunger 312 has been pulled in or not. If the "solenoid in" event occurs, the control logic will start the operation of servo motor 252.

State 2 polled the event of 50 ms. After the passage of 50 ms, solenoid 314 is deactivated and plunger 312 is released. Roller 318 is now rotating on surface 303 under the bias of spring action 305.

State 3 monitors the event that solenoid 314 is deactivated. However if solenoid plunger 312 fails to pull in, there is a failure and State 5 is achieved. The action taken from State 5 is to stop operation of printer 10 and indicate to the operative that a failure in the cutter device has occurred. If solenoid plunger 312 has been pulled in, the action taken is to stop operation of motor 252 and wait 200 ms for inertia of motor 252 to rotate cam 300 so that roller 308 will move into cam step 306 and stop further rotation of the cam and, consequently, pulley 258. The occurrence of this action is illustrated in FIG. 12C. This action places operation into State 4.

It is possible that in State 4, the event of the roller 308 moving into cam step 306 could cause roller 308 to jump laterally out of step 36 and permit cam 300 to rotate. Thus, cam 300 will have rotated to far in manner illustrated in FIG. 12B.

This event is a failure from State 4 which will place operation in State 5 and bring about the termination of printer 10 operation.

In State 4, if cam step 306 has come to rest against roller 308 as illustrated in FIG. 12A, a normal end of events has occurred and operation returns to State 0 to begin the sequence again.

Reference is now made to FIG. 14 which is a schematic circuit diagram of the motor and solenoid control circuitry for printer 10. Operations are carried out under the control of central processing unit (CPU) 320 which is an Intel 8086 microprocessor. CPU 320 is connected via 16-bit address/data bus 322 to an Intel 8255 control chip 324 designated as Port A output. Bus 322 is also connected to an Intel 8255 control chip 326 designated at Port C input. Bus 322 is also connected to input circuit 328 which received medium velocity data and run length data from encoder 281. Timer circuit 330 is also connected to bus 322 and comprises an Intel 8254 triple counter for timing the operation of servo motors 204, 214 and 280.

Output control circuit 324 receives address commands from CPU 320 via bus 322 to conrol the operation and sequence of operation of the servo motors of printer 10.

Connected to circuit 324 are cutter servo motor 252 which is driven via driver 332. Leeward tension motor 240 and forward tension motor 270 are connected to circuit 324 via constant current (torque) circuits (CCC) 334 and 336, respectively. Medium cutter solenoid 314 is connected to output circuit 324 via solenoid driver 338.

Output circuit 324 enables the operation of servo motors 214, 204 and 280. Line 340 from circuit 324 is connected to enable circuit 346 to enable the operation of toner pump motor 214 via driver 352. Line 342 from circuit 324 is connected to enable circuit 348 to enable the operation of roll drive motor 204 via driver 354. Line 344 from circuit 324 is connected to direction logic circuit 35 to enable the operation of main medium drive motor 280 either forward or backward via driver 356.

Figure 15:
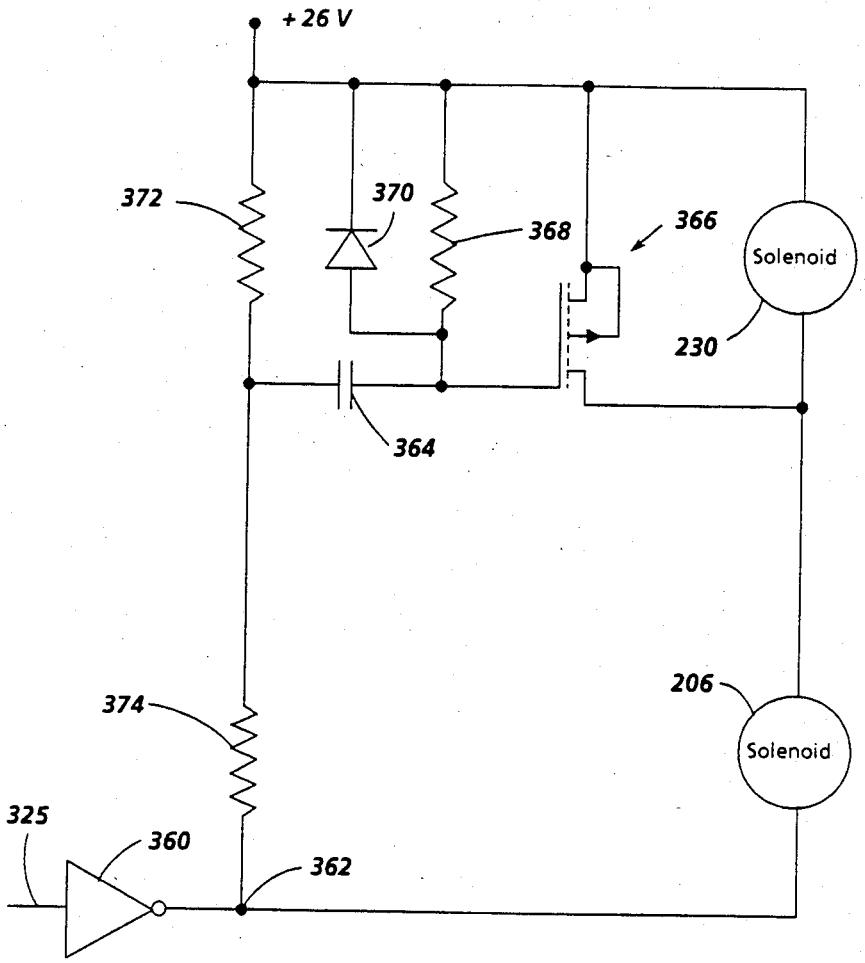
FIG. 15 is a detail circuit diagram of the pump and roll solenoid circuit of FIG. 14.

Output circuit 324 also is connected to control the operation of roll drive solenoid 206 for arm 201 and toner pump solenoid 230 for bracket 210 via line 325 to pump and roll solenoid circuit 358, which is disclosed in detail in FIG. 15. As shown in FIG. 15, a signal on output line 325 will be low at node 362 through operation of inverter 360.

Since a surge of current is needed for initial solenoid activation, it is preferred that roll solenoid 206 be activated prior to toner pump solenoid 230. The RC time constant of capacitor 364 and resistor 368 establishes a delay period during which current to pump solenoid 230 is low while roll solenoid 206 draws full current after which pump solenoid 230 draws full current as described below. Diode 370 is connected across resistor 368 for AC coupling. Resistors 372 and 374 function as a voltage divider.

When node 362 is LOW, the instantaneous voltage on capacitor 364 will drive mosfet 366 into its ON state which has the effect of shorting out toner pump solenoid 230 and supplying full power across roll solenoid 206. Based upon the RC time constant of capacitor 364 and resistor 368, voltage on the gate of mosfet 366 will drop placing mosfet 366 in its OFF state and applying voltage across both toner pump solenoid 230 and roll solenoid 206 to activate the former and maintain both solenoids in an activated state until node 362 goes high due to termination of an output signal on line 325.

Returning again to FIG. 14, pinch roller solenoid 290 for operation of rollers 288 relative to drive roll 16 is connected directly to addres/data bus 322 via bus 376 and latch circuit 378. Head stepper motor 250 and carousel index stepper motor 264 are connected directly to address/data bus 322 via bus 380, latch circuit 382, and respective drivers 384 and 386.

Input circuit 326 has four inputs to receive information from analog sensors that certain events have occurred, which events have been each previously discussed. These events are determination of base position of carousel 30 via carousel index sensor 51; determination of cutter cam roller 308 on surface 303 of cutter cam via flag 315 interrupting the beam of cutter solenoid sensor 318; determination of the beginning point for recording each component color image comprising a composite color image via medium mark sensor 23; and determination of a low level of liquid toner 104 in any one of the toner units 32–38 via toner low reed switch 89.

Figure 16:
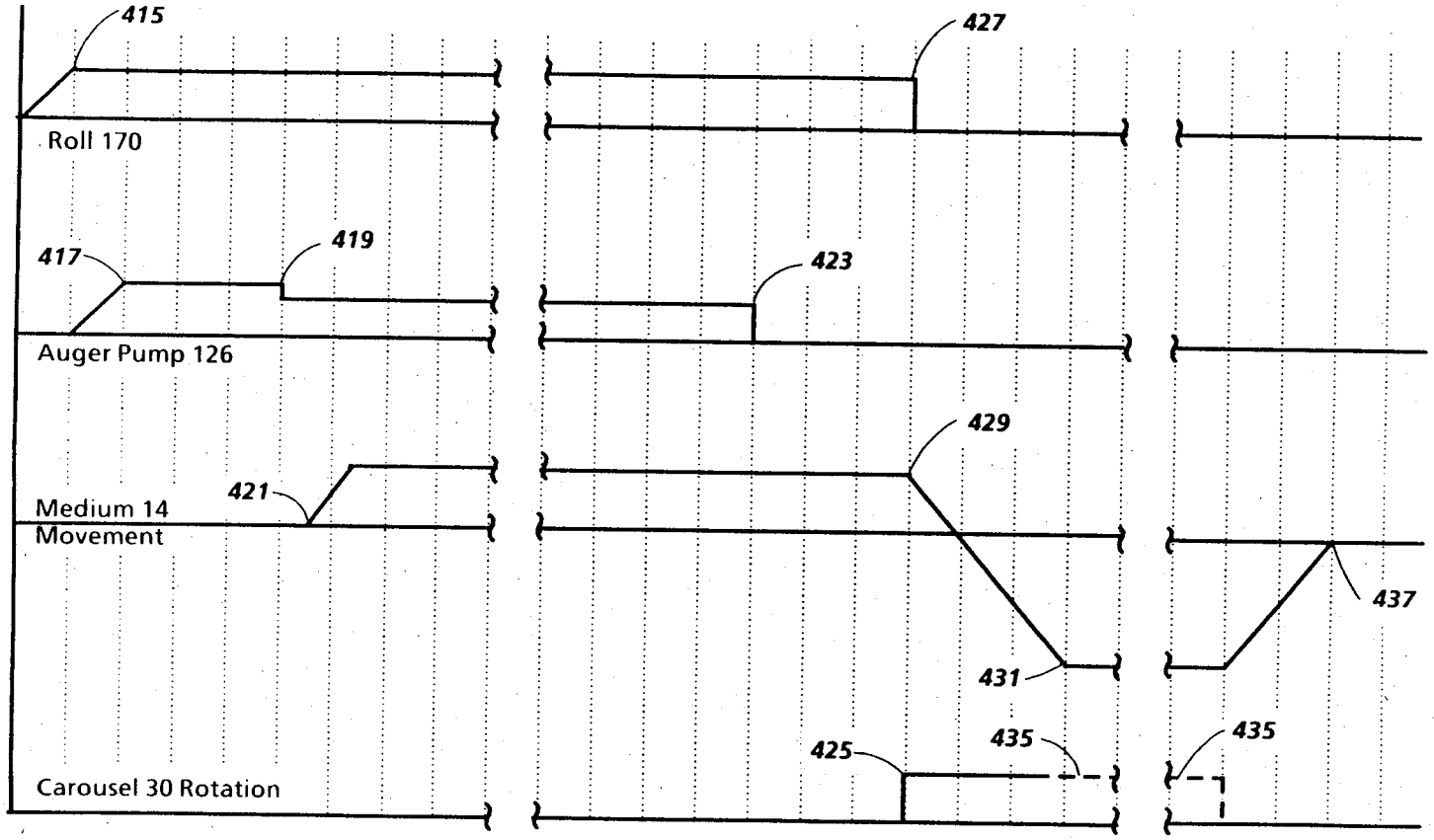
FIG. 16 is a timing diagram showing the sequence of operations provided by the control circuitry of FIG. 12.
Figure 17A:
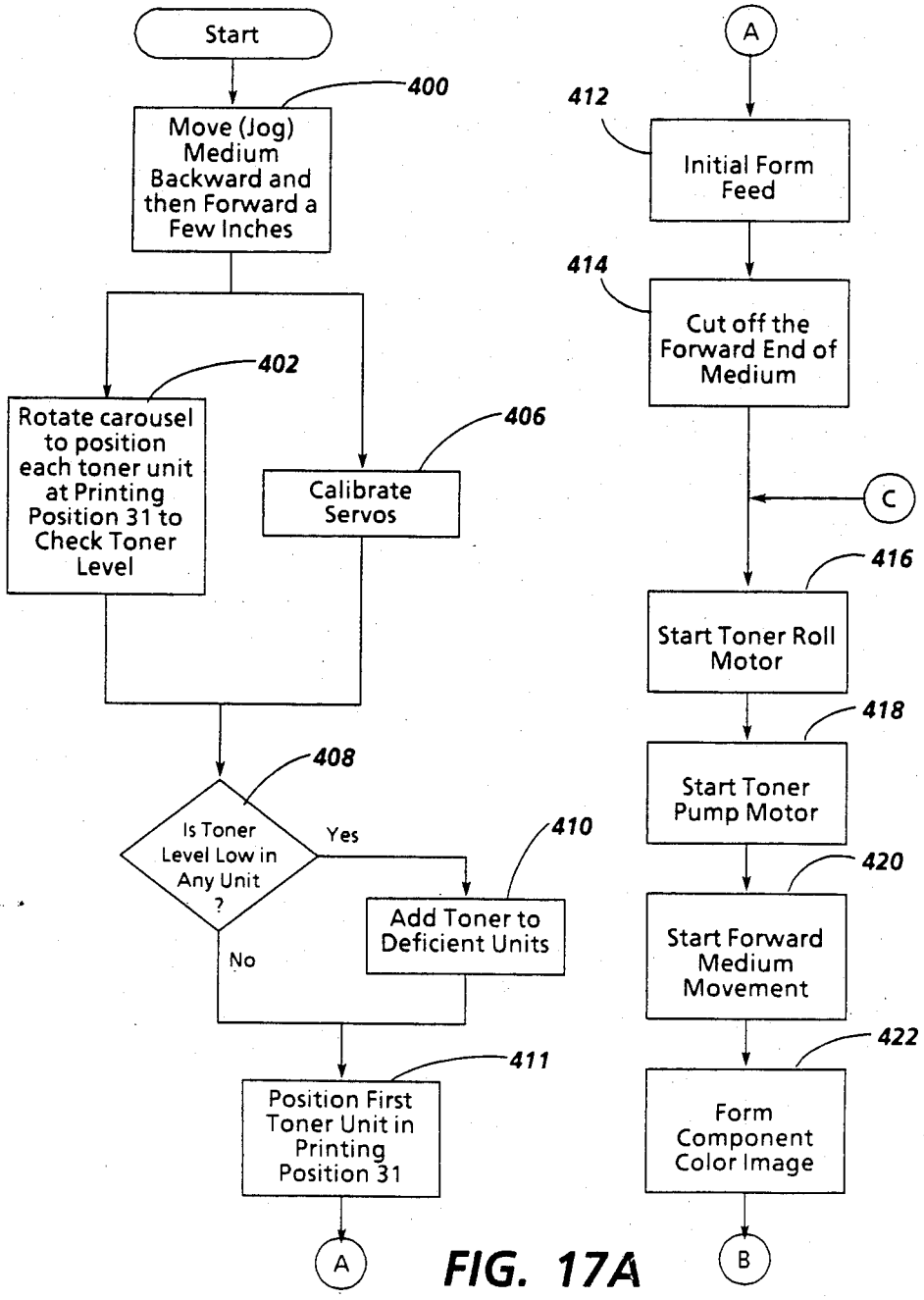
FIGS. 17A and 17B are flowcharts for explaining sequential operation of the printer.
Figure 17B:
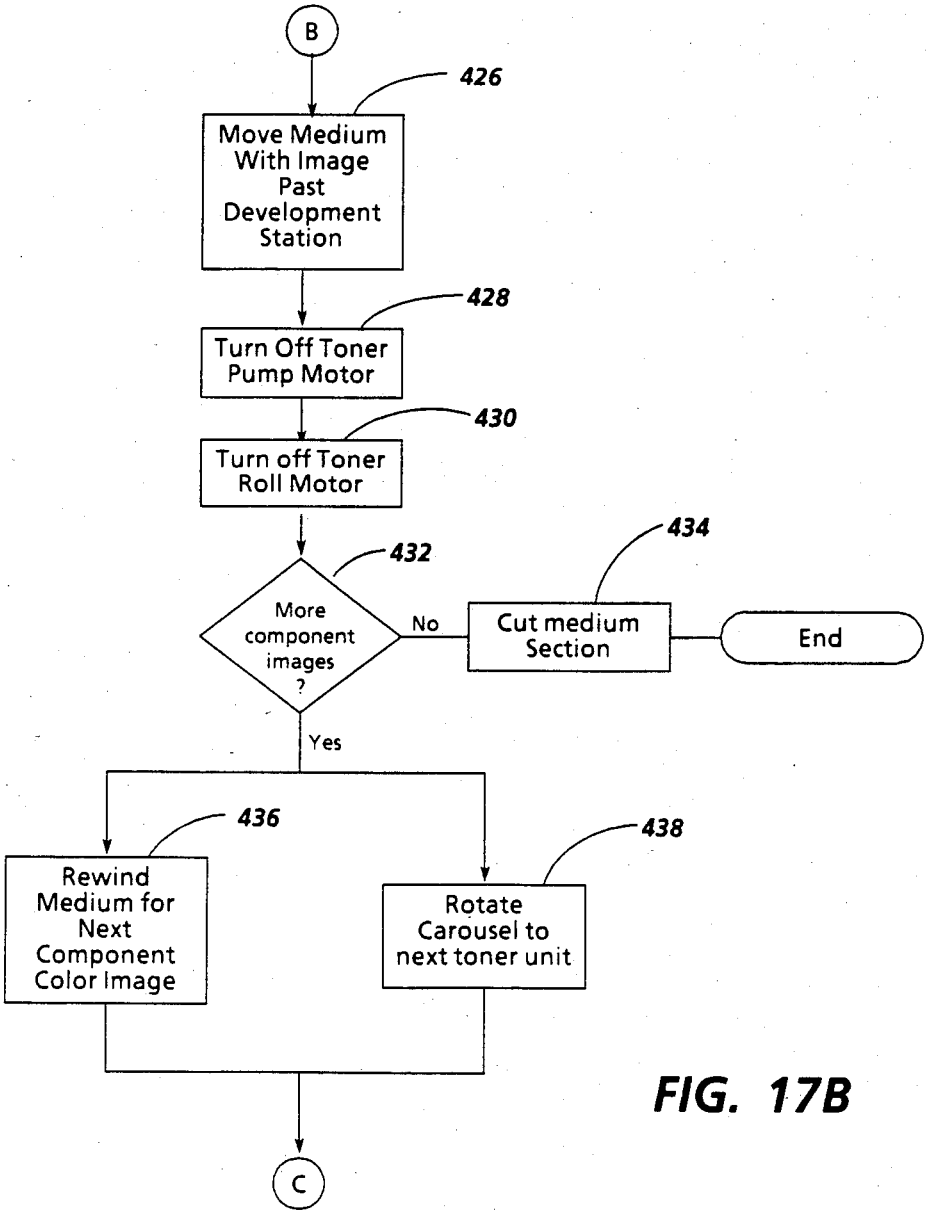

The operation of the control circuitry of FIG. 14 will now be explained in conjunction with the operation of printer 10, in particular with the sequence of operation of the various drive motors during the recording and development of a component image. FIGS. 17A and 17B illustrate by flowchart the sequence of operations that occur in recording and developing a component color image. FIG. 16 is a velocity versus time diagram that illustrates the sequential operation of auger pump 126, roll 170, medium 14 movement via drive motor 280 and carousel 30 rotation via carousel index stepper motor 264.

At the beginning of printer operation, when printer 10 is turned on, a routine called by the printer operating system will automatically move medium 14 forward and then rearward about 2.5 inches to free any sticking of the medium surface to forward tension roll 18 that may have occurred since the previous use of the printer. Toner does become deposited on roll 18 and when printer 10 is turned off for overnight or several days, the medium may adhere to the roll surface. This function is illustrated at box 400 in FIG. 17A. Next, two concurrent functions take place as indicated at boxes 402 and 404. Carousel 30 is rotated via motor 264 to position each toner unit 32–38 at printing position 31 to check the level of toner in each unit. As previously explained this is accomplished with reed switch 89 sensing the condition of floater 81 in each unit. If floater 81 is sufficiently low in any unit, switch 89 will be triggered and the signal developed at input circuit 326 will be employed to indicate a decision at 410, informing the operator that toner needs to be added to the deficient unit as indicated at box 410. At box 406, a calibration is accomplished to synchronize the internal clock of CPU 320 with the clocking of the speed servos associated with digital encoders 20 and 281. This synchronism is accomplished by driving medium 14 forward a few inches to calibrate this timing at low medium velocity of 0.4 ips and at high medium velocity of 2.5 ips. This insures that the medium velocity detected is accurate in relation to the operating system.

After the checking functions of boxes 402 and 406, carousel index motor 264 is operated to position a toner unit in printing position 31, in box 411. This may be the unit already positioned there after completion of the toner check at box 402. In the majority of cases this would be the black liquid toner unit, as it is preferred that this unit be used first to print the medium mark to be detected by sensor 23 along with the black component color image to be formed. However, there are situations where it may be desired to commence operation with another color toner unit in printing position 31.

After toner unit selection and positioning, an initial form feed (FF) command is given as indicated at box 412. This command is a format effector for advancing medium 14 in path 13 a significant amount, e.g. 17 inches, during the first several inches (e.g. 6 inches) of which the roll 170 and pump auger 126 are operated to determine to check to see that these functions are in proper operating condition. The medium is stopped and the forward end of medium 14 is cut off, via cutter 26 and its motor 252 and solenoid 314, indicated at box 414.

Printer 10 is now ready to form the first component image of a composite color image. The sequence of operation is illustrated via boxes 416 through 430 of FIG. 17A and 17B in conjunction with the timing diagram of FIG. 16. As indicated in FIG. 16 and box 416, the first functional operation is auger pump 126. The toner unit having been properly positioned in printing position 31, as determined by operation of stepper motor 264 in conjunction with sensor 51 and roll 220 positioned in slot 228 as shown in FIG. 8, solenoids 206 and 230 are sequentially activated via circuit 358 as previously explained followed by activation (box 416) of roll motor 204 to ramp up roll 170 to its operating velocity, for example, about 100 rpm as indicated at 415 in FIG. 16. This is followed a short time later, such as 100 ms, by activation (box 418) of auger pump motor 214 to ramp up rotation of auger 126 to a velocity that exceeds its normal operating velocity as indicated at 417 in FIG. 16. The purpose of this function is to establish as quickly as possible a toner meniscus at apex 171. After a short period of time, e.g. 300 ms, the velocity of auger pump 126 is reduce about 10% to its normal operating velocity, which may be about 1,000 rpm as indicated at 419 in FIG. 16. A short time after the steady state operation of auger pump 126, forward medium movement is initiated (box 420), as indicated at 421 in FIG. 16. This being the first pass of medium 14, head 22 will electrostatically image, in a conventional, known manner, a start mark along the medium edge followed by the formation of the first component latent electrostatic image a predetermined distance from the mark. The action of the print cycle and medium advance, i.e. laying down rows of charged dots on the medium surface as the same is incrementally moved forward wherein data is sequentially presented to electrodes 15 from the data buffers of printer 10, is well known in the art. The functions of boxes 420 and 422 are terminated together as a data form feed initiated by a control signal callled "End of Transmission" or EOT. Once the data for a component image has been completed to electrodes 15 at head 22, the medium section continue to moves for completion of image development.

With the component image recording completed, the latent image moves past developing station 21, as indicated at box 426, until the trailing edge of the image is toned. At this point, toner auger pump 126 is deactivated as indicated at 423 in FIG. 16 and at box 428. After the trailing edge of the toned image moves past development station 21, roll motor 204 is deactivated as indicated at 427 in FIG. 16 and at box 430. At this point in time, roll solenoid 206 and toner solenoid 230 are simultaneously deactivated wherein the signal on line 325 from control circuit 324 is terminated so that point 362 in circuit 258 is HIGH deactivating these solenoids.

A decision, indicated at box 432, is now made by circuit logic to determine if all the component color images for a composite color image have been produced and toned or if a complete single component color image has been produced and toned. If this condition is true, then cutter motor 252 is activated along with the operation of solenoid 314 to sever the medium section extending out of printer 10 in box 434.

If additional component color images are to be formed, carousel index motor 264 is activated to position the next toner unit into printing position 31 for toning the next component color image as indicated at 425 in FIG. 16 and at box 438 in FIG. 17B. The indexing of carousel 30 can take place anytime after roll 170 via its motor 204 has ceased operation, as indicated by point 425 and 427 being parallel in time in FIG. 16. At the same time, main drive motor 280 is reversed via direction logic 350 to rewind the medium section just recorded and developed back onto roll 12. This function is illustrated as beginning at 429 in FIG. 16 and the higher reverse direction velocity being achieved at point 431. The function is also indicated at box 436 in FIG. 17B. Thus, the rewind operation of the medium section and the indexing of carousel 30 take place at the same time. The amount of time for rewind which is shown broken at 433 in FIG. 16 depends upon the size and length of the image just developed. Also, the amount of time necessary to index the carousel 30 to the next toner unit depends upon which toner color has been called next, which could require either a 90° or 180° or 270° rotation of the carousel. This variable length of time is indicated by the dotted line 435 in FIG. 16. Rewind continues until the developed mark on the medium edge is sensed by sensor 23 and the rewind operation is terminated as indicated at 437 in FIG. 16.

At this point, operation returns to the point indicated at C in FIG. 17A to continue the recording and developing cycle at box 416 for the next component color image.

If all the component color images for a composite color image have been produced and toned, the decision at 432 will be affirmative and the image section severed by cutter 26 via cutter stepper motor 252 and cutter solenoid 314, as indicated at box 434, and the operation is complete.

While the invention has been described in conjunction with a few specific embodiments, it is evident to those skilled in the art that many alternatives, modifications and variations will be apparent in light of the foregoing description. Accordingly, the invention is intended to embrace all such alternatives, modifications and variations as fall within the spirit and scope of the appended claims.

What is claimed is:

1. A toner unit arrangement for a printer comprising:

a rotatable support for being positioned along a path followed by a medium through a printer, at least one toner unit for holding a supply of toner to be applied to the medium, each toner unit being mountable on the support for rotating with the support into a printing position in which toner from that toner unit may be applied to the medium, said support comprises support mounting means for holding each toner unit, each toner unit comprising unit mounting means for engaging the support mounting means when that toner unit is mounted, the support mounting means and the unit mounting means providing a releasable mounting permitting each toner unit to be removed from the support and replaced, one of the support mounting means and the unit mounting means comprises a retractable element movable between an extended position and a retracted position and biased toward the extended position, the other of the support mounting means and the unit mounting means comprising a mounting opening sized to fit around the retractable element, the toner unit being mounted by holding the retractable element in the retracted position until it is positioned at the mounting opening and then permitting the retractable element to move to the extended position so that the toner unit is held in place.

2. A toner developing apparatus for developing a latent image formed on the surface of a moving recording medium comprising a rotating carousel for supporting a plurality of toner units and carrying a toner medium and supported on said carousel for rotation therewith in a maintained upright position, drive means to rotate said carousel and selectively position one of said toner units in a printing position wherein the toner unit so positioned may develop said latent image, drive means to engage a toner unit at said printing position to apply said toner medium to said recording medium, each of said units including a rotatable applicator/-wipe roll and a toner pump within each unit, said drive means to apply said toner medium includes means to drive said roll in a direction opposite to the direction of movement of said recording medium and means to drive said toner pump after activation of said roll drive means, said toner pump drive means is initially driven at a velocity greater than its normal operating velocity to quickly establish a toner meniscus at said roll and said recording medium.

3. The toner developing apparatus of claim 2 wherein said toner pump is an auger pump.

4. The method of developing a latent electrographic image on the surface of a moving recording medium comprising the steps of providing a modular developing unit containing a toner medium and having an applicator/wipe roll for engaging the surface of the recording medium and applying toner, via toner pump in the unit, to the recording medium surface in a region forming an apex at the point where the roll engages the recording medium surface, rotating the roll in a direction opposite to the direction of movement of the recording medium, operating the toner pump at a velocity that exceeds its normal operating velocity to quickly establish a toning meniscus at the apex, and thereafter reducing the velocity of the toner pump to its normal operating velocity.

5. A recording medium cutter apparatus comprising a stationary cutting blade and a rotatable cutting blade mounted on a shaft and positioned relative to said stationary blade to sever a recording medium positioned therebetween, motor drive means coupled to said shaft to rotate said rotatable cutting blade, a cam secured to said shaft and having an instep on the surface thereof, stop means moveably mounted adjacent to said cam and having bias means to maintain said stop means in said cam instep to prevent the rotation of said rotatable cutting blade by said motor drive means, means to engage and remove said stop means from said cam instep and permit the operation of said motor drive means to rotate said rotatable cutting blade one revolution.

said last mentioned means being disengaged prior to the completion of said one revolution to permit said stop means to lodge within said cam instep and terminate the rotation of said rotatable cutting blade.

6. In a toner developing apparatus for developing a latent image formed on the surface of a moving recording medium as the recording medium is moved relative to engagement with said apparatus and comprising:

a rotatably supported developer roll rotated in a direction opposed to the direction of movement of said recording medium and positioned in tangential engagement with said recording medium surface to form a development apex between the circumferential surface of said roll and said recording medium surface, means to pump toner directly along the full length of said formed development apex and form a meniscus with said recording medium surface during the active pumping of said toner, means to drive said pump means when said pumping is activated at an initial volume delivery capacity above its normal operating volume delivery to quickly establish said toner meniscus and thereafter to pump said toner at said normal operating volume delivery.

7. In the toner developing apparatus of claim 6 wherein said apparatus further comprises a reservoir for containing liquid toner, a float slidably mounted in said reservoir for vertical movement therein and floatable on said liquid toner, float sensor means mounted outside of and adjacent to said reservoir for detecting the position of said float therein indicative when said reservoir requires additional liquid toner.

8. In the toner developing apparatus of claim 6 wherein said apparatus further comprises a reservoir for containing liquid toner, said toner pump means comprises an auger screw rotatably mounted in a cylindrically shaped auger tube mounted in the bottom of said reservoir, baffle means mounted on said auger tube to deliver toner pumped from said pumping auger to the surface of said developer roll along the full length of said formed development apex.

9. A modular self-contained toner unit for removably mounting between spaced carousel frame members supported on support means in an electrographic printer comprising a housing containing a lower section for holding toner and an upper section for supporting developer means to engage the surface of a recording medium when said toner unit is positioned at a development station, pumping means in said lower section for directing toner to said developer means to be applied by said developer means to said recording medium surface, means for rotatably mounting both ends of said toner unit relative to said carousel frame members, releasable attaching means forming part of said mounting means at one of said toner unit ends, said releasable attaching means when placed in its retracted position releasing said one end from its carousel frame member permitting removal of said unit from between said carousel frame members, developer drive means mounted on said support means for releasably intercoupling with said developer means when the latter is positioned in said development station, and toner pump drive means mounted on said support means for releasably intercoupling with said pumping means when the latter is positioned in said development station.

10. The modular self-contained toner unit of claim 9 including stabilizing means supported on said support means having a forward bearing member extending toward one end of said toner unit, a bearing member on one end of said toner unit having a cavity positioned between two cam surfaces, means to bias said forward bearing member into engagement with said toner unit bearing member upon movement of said toner unit toward final positioning at said development station, said toner unit bearing member in biased engagement with one of said toner unit cam surfaces upon movement of said toner unit toward final positioning at said development station and in biased engagement in said bearing member cavity when said toner unit is in its final position at said development station to hold firm the positioning of said toner unit in said development station.

11. A modular self-contained toner unit for removably mounting between spaced carousel frame members supported on support means in an electrographic printer comprising a housing containing a lower section for holding toner and an upper section for supporting developer means to engage the surface of a recording medium when said toner unit is positioned at a development station.

pumping means in said lower section for directing toner to said developer means to be applied by said developer means to said recording medium surface, means for rotatably mounting both ends of said toner unit relative to said carousel frame members, stabilizing means supported on said support means having a forward bearing member extending toward one end of said toner unit, a bearing member on one end of said toner unit having a cavity positioned between two cam surfaces, means to bias said forward bearing member into engagement with said toner unit bearing member upon movement of said toner unit toward final positioning at said development station, said toner unit bearing member in biased engagement with one of said toner unit cam surfaces upon said movement of said toner unit toward final positioning at said development station and in biased engagement in said bearing member cavity when said toner unit is in its final position at said development station to hold firm the positioning of said toner unit in said development station.

12. The modular self-contained toner unit of claim 11 including means to bias said bearing member in said cavity in a direction away from the position of said rotatably mounting means at said one end.

13. The modular self-contained toner unit of claim 11 including toner pump drive means mounted on said support means having engagement means to engage corresponding engagement means on said toner unit to drive said pumping means when said forward bearing member is engaged in said cavity after said biased engagement with said one toner unit cam surface upon said movement of said toner unit toward final positioning at said development station, said pumping drive means engagement means and said toner unit engagement means being disengaged from one another when said toner unit is moved out of said development station via said forward bearing member engaging the other of said toner unit cam surfaces of said toner bearing member.

14. A releasably engagable drive apparatus for a developer roll mounted for rotational movement in a developer unit comprising:

a shaft extending axially from one end of said roll and a cross member extending through said shaft perpendicular to the axis of said shaft to form a T-coupler, drive means mounted adjacent to and in axial alignment with said T-coupler and comprising a motor with a motor shaft having a claw coupler mounted at the outer end thereof, said claw coupler comprising a cylindrical shaped hollow body with orthogonally aligned pairs of grooves formed at its forward end defining an axially aligned claw member between adjacent grooves, one side of each claw member having a flat surface and the other side of each claw member having a curved portion extending toward the outer end of each of said one side flat surface to form a curved surface on the forward end of each claw member and means to advance and retract said claw members into and out of engagement with said T-coupler.

* * * * *